US005826149A

United States Patent [19]

Horii et al.

[11] Patent Number: 5,826,149

[45] Date of Patent: Oct. 20, 1998

[54] DEVELOPING DEVICE EMPLOYING A LIQUID DEVELOPER AND PICTURE FORMING DEVICE HAVING SUCH DEVELOPING DEVICE

[75] Inventors: Shinichi Horii, Kanagawa; Hiroshi Tokunaga, Tokyo, both of Japan

[73] Assignee: Sony Corporation, Tokyo, Japan

[21] Appl. No.: 768,174

[22] Filed: Dec. 17, 1996

[30] Foreign Application Priority Data

Dec. 27, 1995 [JP] Japan ..... 7-352004

[51] Int. Cl.[6] ..... G03G 15/10

[52] U.S. Cl. ..... 399/240

[58] Field of Search ..... 399/239, 240; 430/117–119

[56] References Cited

U.S. PATENT DOCUMENTS

| | | | |
|---|---|---|---|
| 3,601,092 | 8/1971 | Satomi . | |
| 4,021,586 | 5/1977 | Matkan | 427/17 |
| 4,155,330 | 5/1979 | Weitzel . | |
| 4,258,115 | 3/1981 | Magome et al. | 430/125 |
| 4,311,780 | 1/1982 | Mochizuki et al. | 430/125 |
| 4,327,664 | 5/1982 | Ohkawa et al. | 399/240 |
| 4,686,936 | 8/1987 | Chow | 399/239 |
| 4,707,112 | 11/1987 | Hartmann | 399/241 |
| 5,477,313 | 12/1995 | Kuramochi . | |
| 5,574,548 | 11/1996 | Lino et al. | 399/240 |

FOREIGN PATENT DOCUMENTS

| | | |
|---|---|---|
| 0246066 | 11/1987 | European Pat. Off. . |
| 0250098 | 12/1987 | European Pat. Off. . |
| 63-571854 | 11/1982 | Japan . |
| 6374083 | 4/1988 | Japan . |
| 03-279986 | 12/1991 | Japan . |
| 06-222677 | 8/1994 | Japan . |
| 9301531 | 1/1993 | WIPO . |

*Primary Examiner*—Robert Beatty
*Attorney, Agent, or Firm*—Jay H. Maioli

[57] ABSTRACT

A developing device employing a liquid developer in which the development speed is increased and a developer squeezing operation may be eliminated while high-speed development and uniform development of the half-tone density may be realized simultaneously. The developing device includes a developer tank 53 containing a liquid developer 1 and a supply roll 3 for uniformly depositing the liquid developer 1 on the surface of the developer roll 54 from the developer tank 53. The liquid developer is comprised of charged toner particles 5A dispersed in an electrically insulating liquid. The charged toner particles 5A are made up of at least a coloring agent and a resin. The developing device also includes an electrical field impressing unit for impressing an electrical field across the liquid developer 1 deposited on the surface of the developer roll 2 for forming a liquid toner layer 6 formed by the charged toner particles 5A collected together. The developer roll 2, holding the liquid toner layer 6 formed by the charged toner particles 5A collected together, is pressed against a photosensitive belt member 7, on which has been formed an electrostatic latent image, for developing the latent image.

6 Claims, 17 Drawing Sheets

-Vb : BIAS VOLTAGE APPLIED ACROSS DEVELOPER CARRIER
$V_1$ : POTENTIAL OF LIQUID TONER LAYER LEFT ON DEVELOPER CARRIER
-Vp : CHARGE POTENTIAL OF PET FILM
$V_2$ : POTENTIAL OF LIQUID TONER LAYER DEPOSITED ON PET FILM

DEVELOPING DEVICE EMPLOYING A LIQUID DEVELOPER AND PICTURE FORMING DEVICE HAVING SUCH DEVELOPING DEVICE

BACKGROUND OF THE INVENTION

1. Field of the Invention

This invention relates to a developing device employed in an image forming method of the electrophotographic system. More particularly, it relates to a developing device employing a liquid developer.

2. Description of the Related Art

Heretofore, in a variety of printers and duplicators, an electrophotographic system (so-called Carlson process) is adopted extensively as a system for image formation. With the electrophotographic system, an image is formed on a recording sheet through a process of electric charging—light exposure—development—transfer—separation. The charge carrier, on which a photoconductive layer has been formed, has its surface uniformly charged to, for example, a negative polarity. In the next light exposure step, laser light irradiation based on image signals is done by, for example, a semiconductor laser, whereby minus charges are decreased or disappear in an exposed portion to form an electrostatic latent image on the surface of the recording sheet.

After an electrostatic latent image has been formed on the surface of a charge carrier, a developer is supplied during the developed process so that a developer image is formed on the surface of an area corresponding to the electrostatic latent image. During the development process, the image is developed by, for example, an electrophoretic developing method employing a liquid developer.

The conventional electrophoretic development method is now explained by referring to FIGS. 1 and 2 showing the states before and after formation of the developer image, respectively.

In this electrophoretic developing method, a charge carrier 104, having an electrostatic latent image 103 formed on its surface, is brought close to a developer carrier 102 of a metal plate carrying a liquid developer 102. A pre-set electrical voltage is applied across the developer carrier 102 or the charge carrier 104 so that a pre-set difference in electrical potential will be present across the developer carrier 102 and the electrostatic latent image 103 on the charge carrier 104. The voltage applied across the developer carrier 102 or the charge carrier 104 is set at a proper value for preventing the carrier texture from becoming roughed. This will occur for example, if, with the developer carrier 102 and the charge carrier 104 lying close to each other, a pre-set voltage is applied across the developer carrier 102 or the charge carrier 104, a developing electrical field 105 is formed between the liquid developer 101 on the developer carrier 102 and the electrostatic latent image 103 on the charge carrier 102.

Charged toner particles 106 on the liquid developer 101 are migrated in this manner from the developer carrier 102 towards the electrostatic latent image 103 on the charge carrier 104 by the electrical potential difference across the developer carrier 102 and the electrostatic latent image 103 on the charge carrier 104. This is the sum of the electrophoretic developing method. The charged toner particles 106, migrated towards the electrostatic latent image 103, are attracted by the electrostatic latent image 103 and deposited thereon to form a developed toner layer 107. The charge carrier 104 is peeled from the developer carrier 102 with the charged toner particles 108 in the developed toner layer 107 affixed thereto, as shown in FIG. 2. The developed toner layer 107 is now formed in an area registering with an area where the electrostatic latent image 103 on the charge carrier 104 has been formed. This indicates that a developer image is formed in register with the electrostatic latent image.

In the above-described conventional developing method, since the charged toner particles 106 are migrated by electrophoresis in a developing electrical field, the developing time is prolonged by the time corresponding to the time of electrophoresis. Thus, it has been difficult to achieve development at a high speed.

For achieving high speed development, it may be contemplated to supply a large quantity of the liquid developer 101 to the developing electrical field 105 or to supply the high-density liquid developer 101 to the developing electrical field 105. However, if a large quantity of the liquid developer 101 has to be supplied to the developing electrical field 105, the developing device is increased in size. In addition, if the high-density liquid developer 101 is used, excess charged toner particles other than the charged toner particles 108 in the developed toner layer 107, become affixed to cause roughening of the texture and deposition of excess toner particles 109 to an image area due to electrophoresis, thus contaminating the base surface and giving rise to deposition of excess charged toner particles 109 on the image area.

Furthermore, in the electrophoretic development method, an excess liquid developer layer is formed on the charge carrier. The result is that a squeezer unit for removing the excess developer needs to be provided downstream of the developing device, thus complicating and increasing the size of the development device. As the squeezer unit, an air knife squeezer, corona squeezer or a reversing roller squeezer are generally used.

Moreover, if a uniform image of a halftone density is to be obtained by the electrophoretic development method, it is necessary to perform development with the liquid developer 101 in a standstill state for eliminating adverse effects of flow pattern fluctuations in the liquid developer 101. This, however, is incompatible with a high-speed developing operation.

The present inventors have conducted perseverant research towards finding a method for producing an image superior in graininess and uniformity in halftone density despite the high development speed employed, and have arrived at a novel development method consisting of preliminarily forming a liquid toner layer comprised of charged toner particles collected on the developer carrier and subsequently pressing the charge carrier onto the liquid toner layer for development.

SUMMARY OF THE INVENTION

It is an object of the present invention to provide a developing method employing the liquid developer whereby the developing speed may be increased and the squeezing operation may be eliminated while uniform development with halftone density may be achieved in congruity with the high developing speed.

In the developing device employing the liquid developer, according to the present invention, the liquid developer is composed of charged toner particles, made up at least of a coloring agent and a resin, with the charged toner particles being dispersed in an electrically insulating liquid. The liquid developer is uniformly deposited on a developer carrier. An electrical field is impressed across the developer carrier for forming a liquid toner layer made up of the charged toner particles assembled together. A charge carrier, on which an electrostatic latent image has been formed, is pressed against the developer carrier, holding the toner layer made up of the charged toner particles assembled together, in order to effect development, whereby the charged toner particles, forming the liquid toner layer made up of the charged toner particles assembled together, are separated depending on the direction of the electrical field formed between the developer carrier and the charge carrier, for forming a developed image corresponding to the latent image on the charge carrier.

For forming the liquid toner layer made up of the charged toner particles assembled together, uniform deposition of the liquid developer on the developer carrier and impression of the electrical field are effected simultaneously or sequentially.

The above-described development device employing a liquid developer according to the present invention includes a developer container containing the liquid developer comprised of charged toner particles at least made up of a coloration agent and a resin. The charged toner particles are dispersed in an electrically insulating liquid. The development device also includes developer supplying means for uniformly depositing the liquid developer from the developer container on the surface of a developer carrier and electrical field impressing means for impressing an electrical field across the liquid developer deposited on the surface of the developer carrier for forming a liquid toner layer comprised of charged toner particles assembled together.

In the development device employing the liquid developer according to the present invention, the charge carrier having formed thereon the electrostatic latent image is pressed against the developer carrier, holding the liquid toner layer comprised of charged toner particles assembled together, in order to effect development. The charged toner particles, forming the liquid toner layer, comprised of charged toner particles assembled together, are separated depending on the direction of the electrical field formed between the developer carrier and the charge carrier for forming a developer image corresponding to the latent image the charge carrier. Also, with the developing device employing the liquid developer, uniform deposition of the liquid developer on the developer carrier and impression of the electrical field are effected simultaneously or sequentially for forming the liquid toner layer comprised of charged toner particles assembled together.

An image forming device according to the present invention includes a charge carrier, an image-forming processing unit, a recording sheet supplied from a recording sheet supplying unit and brought into tight contact with the surface of the charge carrier supplied from the recording sheet supplying unit, a transfer unit and a separation unit for separating the recording sheet from the charge carrier. The charge carrier has a developer image formed thereon. The transfer unit is arranged along the running path of the charge carrier and adapted for tightly contacting the recording sheet from the recording sheet supply unit with the charge carrier surface for transferring the developer image formed on the charge carrier to the recording sheet.

The image-forming processing unit includes an electrifying unit for electrifying the entire surface of the charge carrier, a light exposure unit for exposing the surface of the charge carrier based on image signals for forming an electrostatic latent image, and a developing unit for supplying the liquid developer to the surface of the charge carrier for developing the electrostatic latent image.

The developing unit includes a developer container containing the liquid developer comprised of charged toner particles at least made up of a coloration agent and a resin. The charged toner particles are dispersed in an electrically insulating liquid. The developing unit also includes developer supplying means for uniformly depositing the liquid developer from the developer container on the surface of a developer carrier, and electrical field impressing means for impressing an electrical field across the liquid developer deposited on the surface of the developer carrier for forming a liquid toner layer comprised of charged toner particles assembled together.

With the above-described image forming device according to the present invention, the charge carrier having the electrostatic latent image formed thereon is pressed against the developer carrier holding the liquid toner layer comprised of charged toner particles assembled together, thereby effecting the development. The charged toner particles, which have formed the liquid toner layer comprised of charged toner particles assembled together, are separated depending on the direction of the electric field produced between the developer carrier and the charge carrier for forming the developer image corresponding to the latent image on the charge carrier. In addition, with the present image forming device, uniform deposition of the liquid developer on the developer carrier and impression of the electrical field are carried out in the development means simultaneously or sequentially for forming the liquid toner layer comprised of the charged toner particles collected together on the developer carrier.

With the above-described developing device employing the liquid developer according to the present invention, since the liquid developer is affixed on the developer carrier and, after forming the liquid toner layer comprised of charged toner particles collected together by impression of the electrical field, the developer carrier is pressed against the charge carrier for development, the liquid toner layer is separated depending on the direction of the electrical field formed in the liquid toner layer comprised of the charged toner particles collected together, at the same time as the developer carrier is pressed against the charge carrier, without the charged toner particles being migrated as in the electrophoretic development method, thus enabling high-speed development.

Since the developer carrier is pressed against the charge carrier after formation of the liquid toner layer comprised of the charged toner particles collected together on the developer carrier, no superfluous liquid developer layer is formed on the charge carrier, such that a squeezing operation, required in the conventional electrophoretic development, may be eliminated.

Moreover, with the present developing device employing the liquid developer, if the liquid toner layer comprised of the charged toner particles collected together is formed on the developer carrier, the liquid toner layer comprised of the charged toner particles collected together is separated depending on the direction of the electrical field formed in the toner layer, for effecting development in conjunction with the pressure contact of the developer carrier with the charge carrier. Thus, the charged toner particles faithfully corresponding to the charge density on the charge carrier are developed, thus realizing a developed image having uniform half-tone density.

In addition, since it is sufficient if the liquid toner layer comprised of the charged toner particles collected together is formed on the developer carrier in the developing unit, there is raised no problem such as encountered in conventional electrophoretic development device, such as contamination of the base surface or deposition of superfluous charged toner particles on an image area, thus enabling the use of high-density liquid developer.

Thus, with the developing device employing the liquid developer according to the present invention, the development speed is increased and the squeezing operation is eliminated, while uniformity of half-tone density and graininess may be realized easily. Since the liquid developer of high density may be used, a high-definition image of liquid development may be realized easily and speedily with a small-sized development device.

Also, with the image forming device according to the present invention, since the liquid developer is affixed on the developer carrier, while the electrical field is impressed for forming the liquid toner layer comprised of charged toner particles collected together, and subsequently the developer carrier is pressed against the charge carrier for development, the charged toner particles are not migrated as in the electrophoretic process, but the liquid toner layer is separated depending on the direction of the electrical field formed in the liquid toner layer comprised of the charged toner particles in the assembled state, thus enabling high speed development.

With the present image forming device, the developer carrier of the developing unit is contacted with the charge carrier after the liquid toner layer comprised of the charged toner particles collected together is formed on the developer carrier, so that no superfluous liquid developer layer is formed on the charge carrier, thus eliminating the squeezing operation for the superfluous developer layer as required in the conventional electrophoretic method.

Moreover, with the present image forming device, if the liquid toner layer of the charged toner particles collected together is formed on the developer carrier, the liquid toner layer is separated depending on the direction of the electrical field formed in the liquid toner layer for effecting development in conjunction with the pressure contact. Thus the charged toner particles faithfully corresponding to the charge density on the charge carrier are developed for producing a developer image of uniform half-tone density.

In addition, since it is only necessary that the liquid toner layer comprised of the assembled charged toner particles be formed on the developer carrier, there is no problem such as base surface contamination or deposition of excess charged toner particles in the image area as encountered with the conventional electrophoretic development devices, thus enabling the use of a high-density developer.

Thus, with the present image forming device, the development speed is elevated and the squeezing operation may be dispensed with in the development unit, while the uniform half-tone density may be achieved easily and the high-density developer can be used, so that a high-definition image by liquid development may be easily and speedily realized with the small-sized device.

BRIEF DESCRIPTION OF THE DRAWINGS

FIG. 25 is a schematic view for illustrating the state of forming a developer image on a charge carrier by a developing device employing a conventional liquid developer.

FIG. 26 is a schematic view for illustrating the state in which the developer image has been formed on the charge carrier by the developing device employing the conventional liquid developer shown in FIG. 25..

DESCRIPTION OF THE PREFERRED EMBODIMENTS

Figure 1:
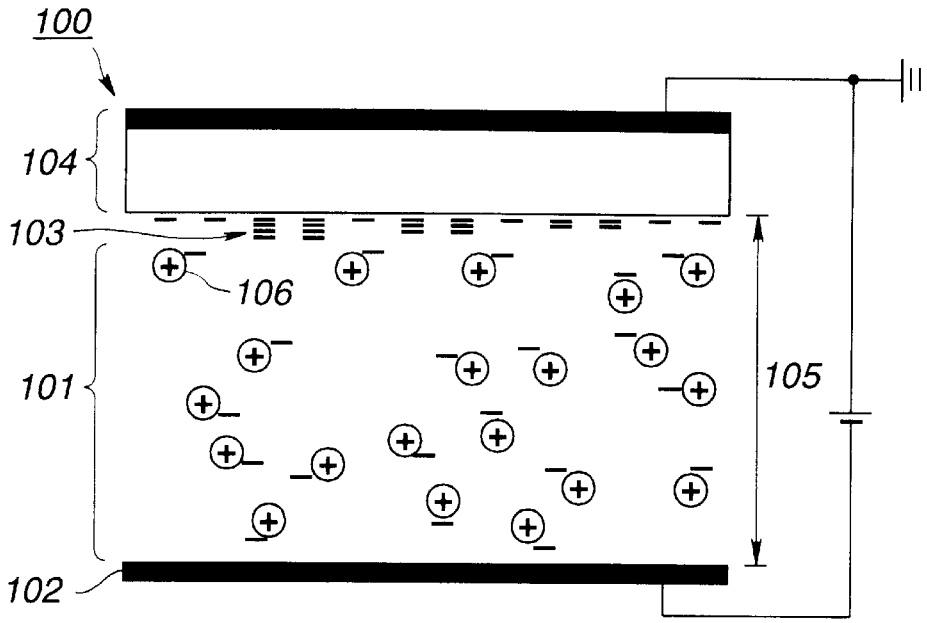
PRIOR ART FIG.1
FIGS. 1 and 2 show the states before and after formation of a developer image by the conventional electrophoretic development method, respectively.
Figure 2:
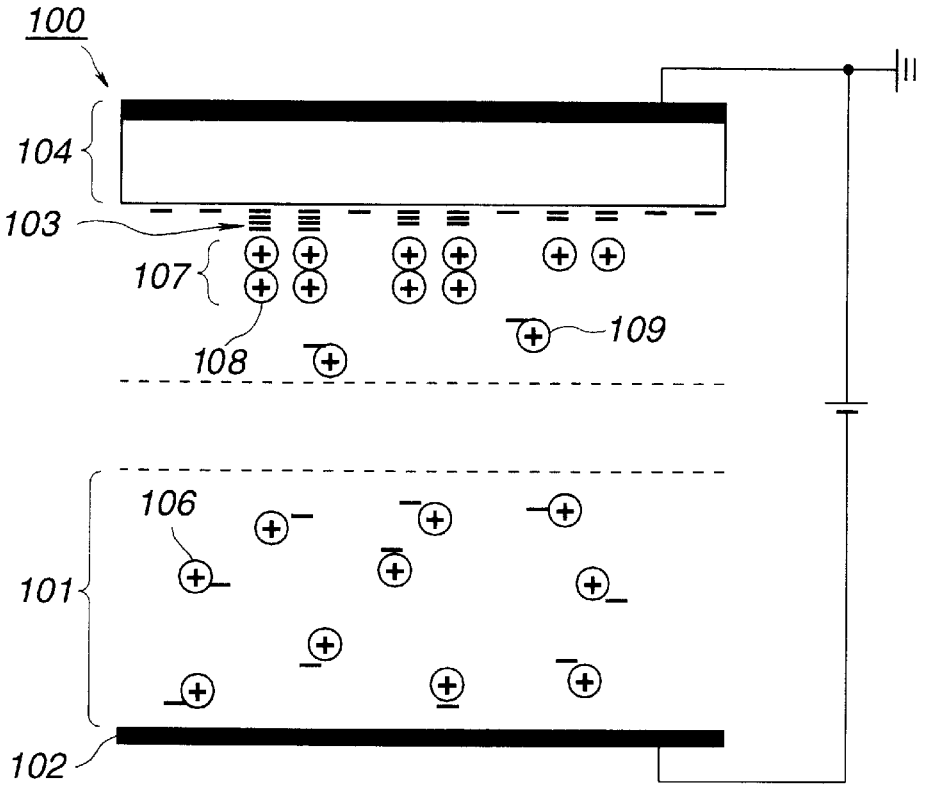
PRIOR ART FIG.2

Referring to the drawings, preferred embodiments of the present invention will be explained in detail. As shown in FIGS. 3 to 8, a developing device employing a liquid developer according to the present invention is provided in a laser printer 10.

Figure 3:
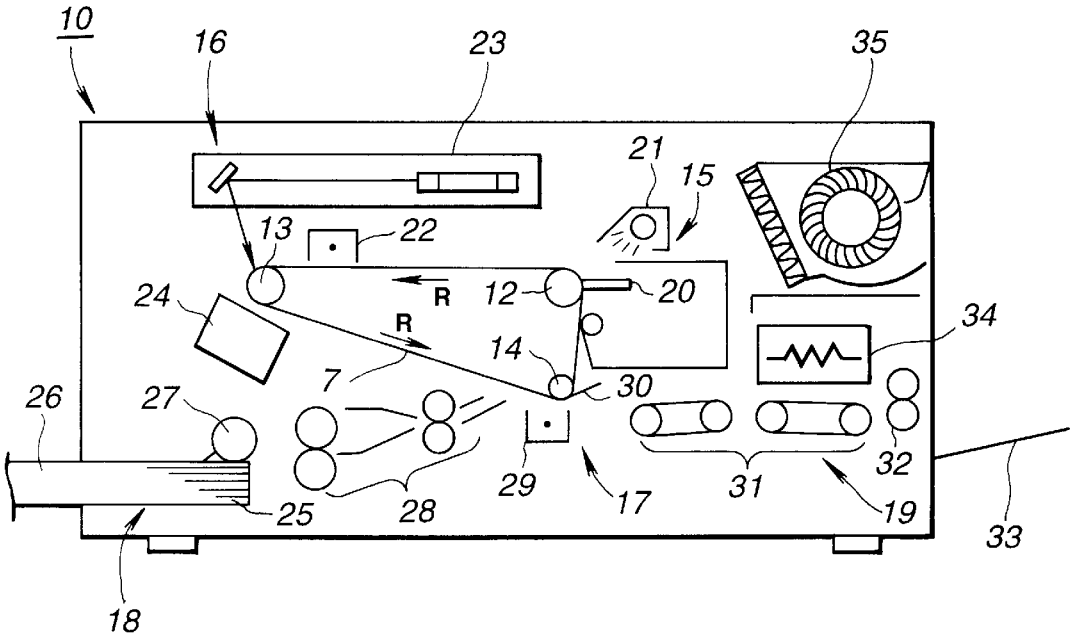
FIG. 3 schematically shows a laser printer according to the present invention.

Referring to FIG. 3, the laser printer 10 has a photosensitive belt member 7 placed around plural roll sets 12 to 14 for being run in an endless fashion. The laser printer 10 also includes a cleaning unit 15, an image-forming processing unit 16, a transfer-separation unit 17, a recording sheet supplying unit 18 for supplying a recording sheet 25 to the transfer-separation unit 17, and a discharging unit 19 for discharging the recording sheet 25 separated from the photosensitive belt member 7. The cleaning unit 15, image-forming processing unit 16, transfer-separation unit 17, recording sheet supplying unit 18 and the discharging unit 19 are arranged in this order along the running path of the photosensitive belt member 7.

The photosensitive belt member 7 is comprised of an electrically conductive substrate 7A on the surface of which is formed a photosensitive layer 7B formed of an organic or inorganic photoconductive material. The photosensitive belt member 7 has its leading and trailing ends connected together to form an endless belt. The roll sets for running the photosensitive belt member 7 is made up of plural rolls 12 to 14, of which the roll 13 is a driving roll. The photosensitive belt member 7 is placed around these rolls 12 to 14 to form a running path in the form of a substantially right-angled triangle and is run in a direction shown by an arrow R in FIG. 3.

The cleaning unit 15 is arranged on the outer peripheral part of the first roll 12 ahead of the image-forming processing unit 16 along the running direction of the photosensitive belt member 7. The cleaning unit 15 is made up of a blade 20 for removing a liquid developer 1 affixed on the surface of the photosensitive belt member 7 and a electrifying lamp 21 for de-electrifying the surface of the photosensitive belt member 7 electrified in the image-forming step. The photosensitive belt member 7 impinges on the foremost part of the blade 20 whereby the liquid developer 1 left on its surface is removed. In addition, the photosensitive belt member 7 is irradiated with a de-electrifying lamp 21 for being freed of residual positive charges.

The photosensitive belt member 7, having its surface cleaned by the cleaning unit 15, runs to the image-forming unit 16 for forming an image thereon. The image-forming processing unit 16 is made up of a first electrifying unit 22, a laser light exposure unit 23, forming light exposure means, and a developing device 24.

The first electrifying unit 22 is comprised of a corona charger arranged in proximity to the surface of the photosensitive belt member 7 for uniformly electrifying the surface of the photosensitive belt member 7 with negative charges.

A laser light exposure unit 23 is actuated responsive to image signals sent from a controller, not shown, for selectively irradiating the surface of the photosensitive belt member 7 with a laser beam via an optical system, not shown. On illumination by the laser light, the negative charges on the light-exposed surface of the photosensitive belt member 7 are removed for forming an image corresponding to the image signals.

After formation of the electrostatic latent image in the laser light exposure unit 23, the photosensitive belt member 7 travels to the developing unit 24 for development. The developing device 24 supplies the liquid developer 1 to the surface of the photosensitive belt member 7 for forming a developed image from the electrostatic latent image, as will be explained in detail subsequently. The photosensitive belt member 7 travels further and is reversed in its traveling direction by the second roll 14. In this direction reversing portion, the recording sheet 25 is supplied from the recording sheet supply unit 18.

The recording sheet supply unit 18 is made up of a paper supplying unit 27, not explained in detail, for feeding out recording sheets 25 stored in a paper feed cassette 26 one-by-one and a guide roll unit 28 for transporting the fed-out recording sheets. The recording sheet 25 is fed under a minor pressure to the surface of the photosensitive belt member 7, so that the sheet 25 is brought into tight contact with the photosensitive belt member 7.

The photosensitive belt member 7 is run along the running path defined between the driving roll 13 and the second roll 14 with the recording sheet 25 tightly affixed to its surface. Thus, the developer image formed on the surface of the photosensitive belt member 7 is transferred to the recording sheet 25.

The transfer-separation unit 17 is provided on the running path along which travels the photosensitive belt member 7 on which is superimposed the recording sheet 25. The transfer-separation unit 17 is made up of a second electrifying unit 29, second roll 14 and a separation pawl 30.

The second electrifying unit 29 uniformly electrifies the entire surface of the recording sheet 25, from its non-transfer side, with negative charges of the opposite polarity to the positive charges on the developer image formed on the surface of the photosensitive belt member 7.

The photosensitive belt member, which has traveled as far as the second roll 14, is changed in its running direction towards the first roll 12. This separates the recording sheet 25 from the photosensitive belt member 7 to discharge the recording sheet 25 along the separation pawl 30 towards the discharging unit 19.

The discharging unit 19 is made up of plural transporting belts 31 for transporting the recording sheet 25, a paper discharging roll 32, a fixing unit 34 for fixing the developer image on the transported recording sheet 25 and a discharging saucer 33 for receiving the recording sheet 25 on which the developer image has become fixed. The fixing unit 34 is made up of, for example, an electrical heater, and thermally fixes the developer image by the liquid developer 1 transferred to the recording sheet 25 for fixing the image to the recording sheet 25.

The photosensitive belt member 7 is reversed at the second roll 14 in its running direction towards the first roll 12 for being freed of the recording sheet 25, and travels further to the cleaning unit 15. The photosensitive belt member 7 is de-electrified and cleaned by the cleaning unit 15, as described above, and further travels to the image-forming unit 16 to perform the next image-forming operation. The laser printer 10, fitted with the above-described photosensitive belt member, is also fitted with an exhaust fan 35.

The laser printer 10 is fitted with the developing unit 24 employing the liquid developer as described above. In the following description of the developing device 24 employing the liquid developer, it is assumed that the toner particles have been charged to the positive polarity. However, the following explanation holds if the toner particles are charged to the negative polarity, in which case the polarity of the impressed voltage has to be reversed.

Figure 4:
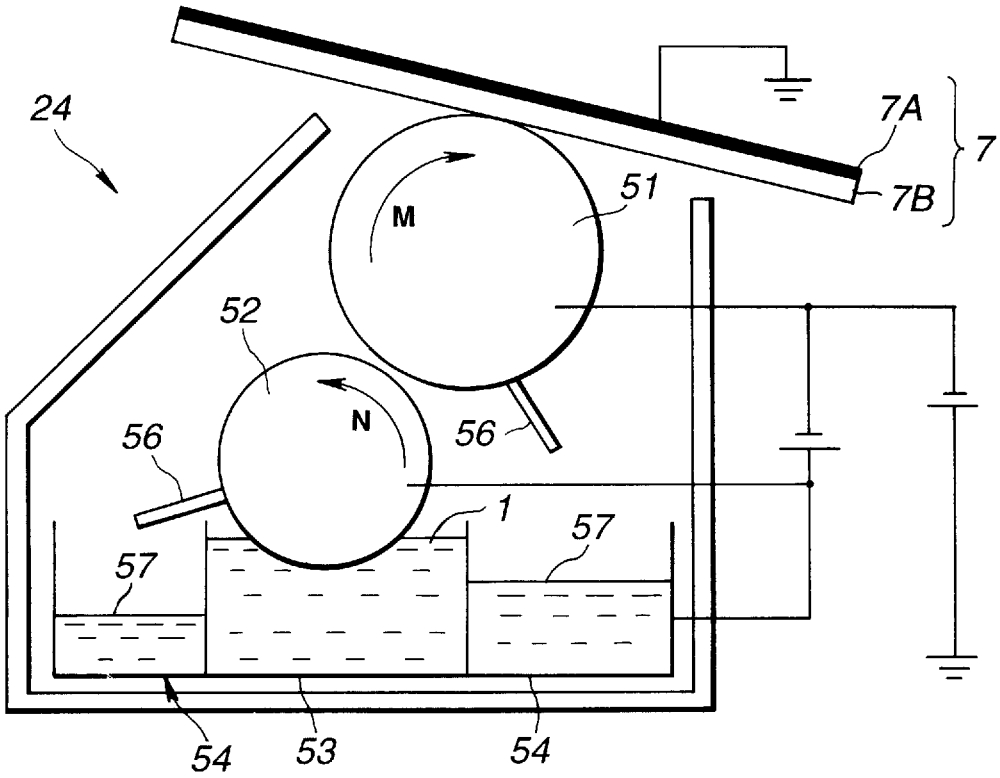
FIG. 4 schematically shows a developing device employing a liquid developer according to the present invention.

The developing device 24, employing the liquid developer, is made up of the above-mentioned liquid developer 1, a developing roll 51, an electrical field impressing roll 52, a developer tank 54 and a recovery tank 53, as shown in FIG. 4.

The developing roll 51 is run in rotation, in a direction indicated by arrow M in FIG. 4, at a rotational speed equal to the traveling speed of the photosensitive belt member 7, having its electrically conductive substrate 7A grounded, and is kept in pressure contact with the surface of the photosensitive belt member 7. A development bias voltage is applied across the developing roll 51 formed of an electrically conductive material, such as metal.

Instead of being formed only of metal, the developing roll 51 may also be constructed by forming an electrically conductive elastic layer on the surface of the developing roll 51 formed of an electrically conductive material or by laminating both an electrically conductive elastic layer and an electrically conductive surface layer on the surface of the developing roll 51 formed of an electrically conductive material.

The electrical field impressing roll 52 is arranged in proximity to the surface of the developing roll 51 with an appropriate gap in-between, and is run in rotation in a direction indicated by arrow N in FIG. 4. The electrical field impressing roll 52 is formed of an electrically conductive material, such as metal. A positive charge relative to the potential of the developing roll 51 is impressed across the electrical field impressing roll 52. Meanwhile, the roll 52 may be run in rotation in a direction opposite to the direction indicated by arrow N in FIG. 4.

In the developer tank 53 is contained an unused liquid developer 1. The developer tank 53 is arranged so that part of the peripheral surface of the electrical field impressing roll 52 is dipped in the liquid developer 1. An electrical voltage equal to that applied across the electrical field impressing roll 52 is applied across the developer tank 53 formed of an electrically conductive material, such as metal.

The recovery tank 54 is formed of an electrically conductive material, such as metal, and is integrally mounted with the developer tank 53. An end of a scraper 56 formed of an elastic material is fitted on the recovery tank 54. The other end of the scraper 56 is abutted against the developing roll 51 and the electrical field impressing roll 52 for removing any liquid developer 57 left on the surfaces of the rolls 51, 52. The liquid developer 57 left on the surfaces of the rolls 51, 52 is recovered into the recovery tank 54.

With the above-described developing device 24, employing the liquid developer, the electrical field impressing roll 52 is first rotated in a direction indicated by arrow N in FIG. 4 so that a large quantity of the liquid developer 1 is taken out of the developer tank 53 for deposition thereon. The electrical field impressing roll 52 is further run in rotation for removing superfluous liquid developer 1 so that a liquid developer layer 4 of a thickness substantially equal to the distance from the roll 52 to the developing roll 51 is formed between the rolls 51 and 52.

Figure 5:
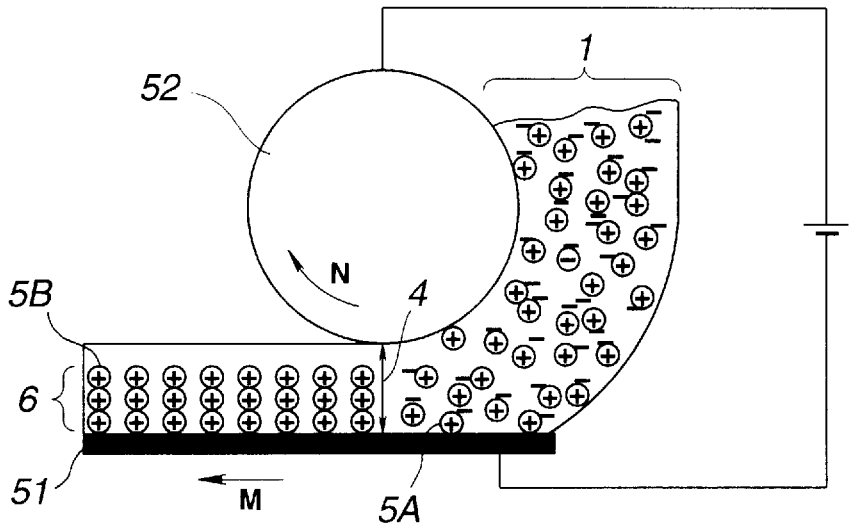
FIG. 5 schematically shows the state of forming a liquid toner layer on a developer roll by the developing device.
Figure 6:
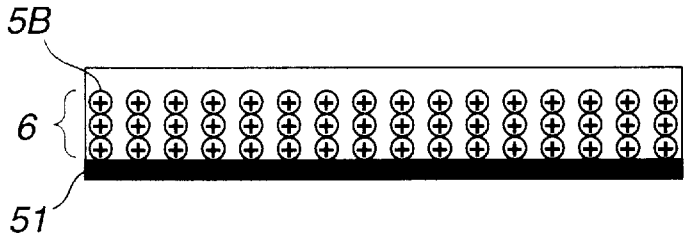
FIG. 6 schematically shows the liquid toner layer formed by the developing device.

Simultaneously with formation of the liquid developer layer 4, the electrical field impressing roll 52 produces the phenomenon of electrophoresis in charged toner particles 5A in the liquid developer layer 4, depending on the difference in the electrical potential across the rolls 51 and 52, as shown in FIG. 5. The charged toner particles 5A in the liquid developer layer 4 are attracted by the developer roll 51, which is at a lower electrical potential than that of the electrical field impressing roll 52, while being electrified to a positive charge by the rolls 51 and 52. The electrified toner particles 5B are migrated towards the developer roll 51, as shown in FIG. 6, so as to be collected on the developing roll 51 to form a liquid toner layer 6.

Figure 7:
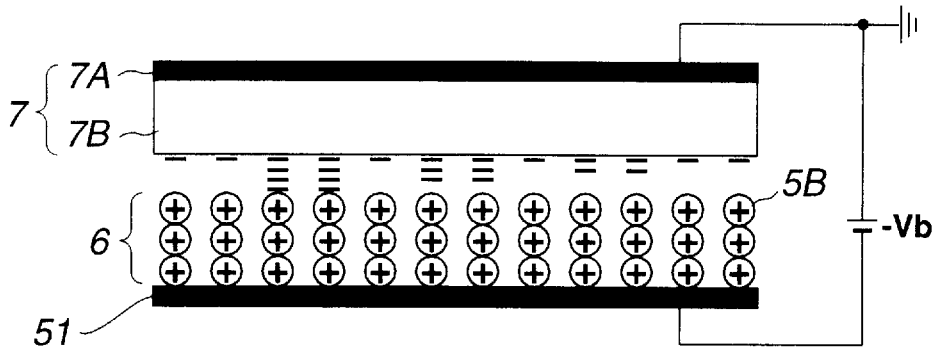
FIG. 7 schematically shows the state of forming a developer image on a photosensitive member belt by the developing device.
Figure 8:
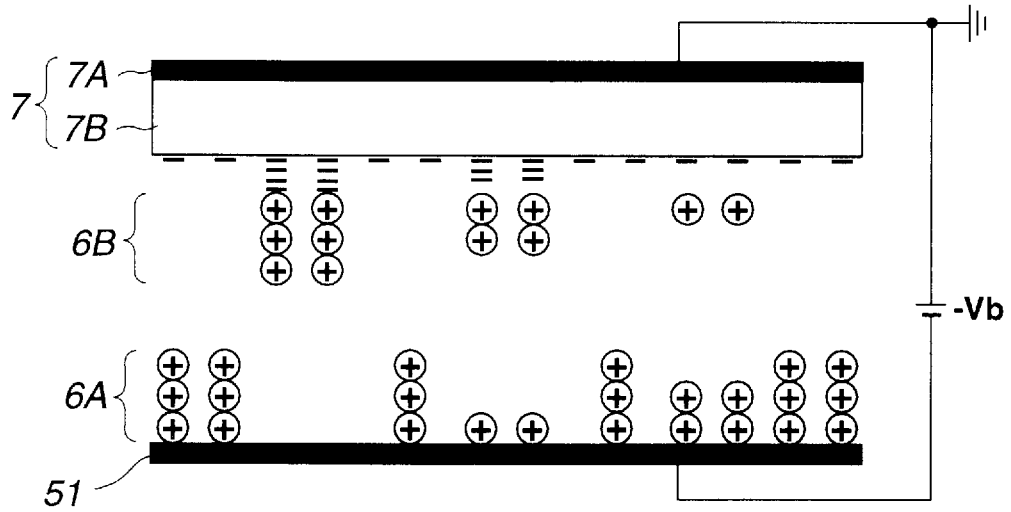
FIG. 8 schematically shows the state in which the developer image has been formed on the belt photosensitive member by the developing device.

The developing roll 51, on the surface of which the liquid toner layer 6 has been formed, is further run in rotation in a direction indicated by arrow N in FIG. 4. At this time, a negative voltage $-V_b$ with respect to the electrically conductive substrate 7A of the photoconductive belt member 7 is impressed across the developing roll 51, as shown in FIG. 7. The photoconductive belt member 7 is contacted in this state with the surface of the liquid toner layer 6 on the developing roll 51. The liquid toner layer 6 is supplied at this time to the surface of the photoconductive belt member 7, as shown in FIG. 8, for forming a developer image from the electrostatic latent image on the photoconductive belt member 7, as will be explained later in detail.

Meanwhile, the photoconductive belt member 7 is not limited to the electrically conductive substrate 7A having the photosensitive layer 7B formed thereon, but may also be comprised of a dielectric member having an electrostatic latent image formed thereon by, for example, an electrified needle.

With the developing device 24 employing the liquid developer, the liquid developer 1 is affixed to the developer roll 51, while the roll 52 is pressure-contacted with the photoconductive belt member 7, after an electrical field is applied for forming the liquid toner layer 6, for effecting development. Thus, the liquid toner layer 6 is separated, depending on the direction of the electrical field formed in the liquid toner layer 6, so that development occurs in conjunction with the pressure contact between the roll 51 and the photoconductive member 7, instead of by migration of the charged toner particles 5A as in the case of the electrophoretic developing device 100, thus enabling high-speed development.

In addition, with the developing device 24 employing the liquid developer, since the developing roll 51 is brought into pressure contact with the photoconductive member 7 after the liquid toner layer 6 is formed on the roll 51, there is formed no superfluous liquid developer layer 4 on the photoconductive member 7, such that the operation for squeezing the superfluous liquid developer layer 4, such as is required in the conventional electrophoretic device 100, may be eliminated.

Also, with the developing device 24 employing the liquid developer, if the liquid toner layer 6 has been formed on the developer roll 51, the liquid toner layer 6 is separated, depending on the direction of the electrical field formed in the liquid toner layer 6, in order to effect development in conjunction with pressure contact between the developing roll 51 and the photoconductive member 7, so that the charged toner particles 5B faithfully corresponding to the density of charges on the photoconductive belt member 7 may be developed for realizing a developer image with uniform half-tone density.

Moreover, with the developing device 24 employing the liquid developer, since it is sufficient if the liquid toner layer 6 is formed on the developer roll 51, therefore, if the charged toner particles 5B on the liquid developer 1 used are of high density, contamination of the base surface or deposition of superfluous charged toner particles 5B on the image portion, as encountered with the conventional electrophoretic developing device 100, may be evaded, thus enabling the use of the high-density liquid developer 1.

Therefore, with the developing device 24 employing the liquid developer, since the developing speed is high and the squeezing operation is unnecessary, while uniform half-tone density and graininess may be realized easily and the high-density liquid developer may be used, high definition liquid developer image can be realized easily and speedily by a small-sized developing device.

Figure 9:
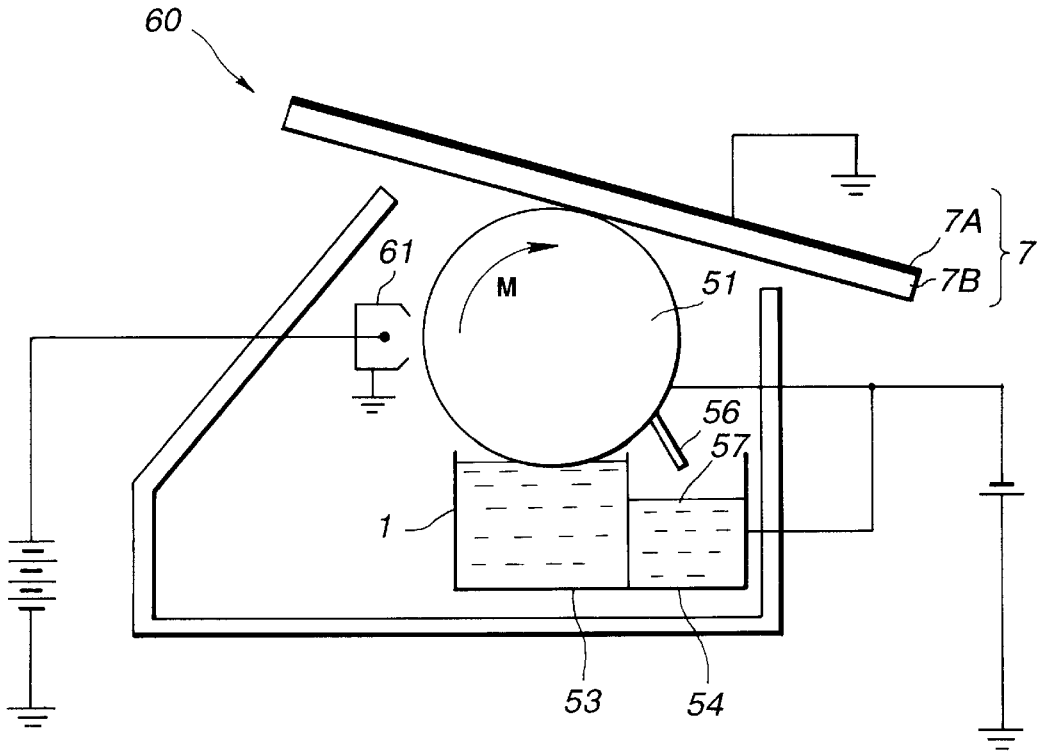
FIG. 9 is a schematic view for illustrating a first embodiment of a developing device employing the above liquid developer.
Figure 10:
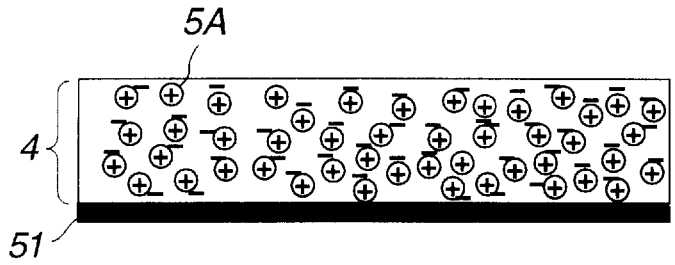
FIG. 10 schematically shows a liquid developer layer formed on the developer roll by the developing device of FIG. 9.

The developing device 24 employing the liquid developer is not limited to the above-described embodiments. For example, the present invention may be extended to first and second embodiments of the developing devices 60, 70 employing the liquid developer, as shown in FIG. 9. The first and second embodiments of the developing devices 60, 70, employing the liquid developer, have the basic construction in common with the above-described developing device employing the liquid developer, as shown in FIGS. 9 to 18. In the following description, the parts or components similar to those of the above-described developing device employing the liquid developer are depicted by the same reference numerals and the corresponding description is omitted for clarity.

The developing device 60, as the first embodiment, is characterized by electrifying the liquid developer layer 4 deposited on the developer roll 51 by corona charging instead of by using the electrical field impressing roll 52. With the developing device 60 employing the liquid developer, the developer tank 53 is arranged so that part of the peripheral surface of the developer roll 51 is directly dipped in the liquid developer 1. The same voltage is applied across the developer tank 53 as that applied across the developing roll 51. With the developing device 60, employing the liquid developer, corona discharging is applied by a corona charger 61 to the liquid developer layer 4 formed by deposition of the liquid developer 1 on the developing roll 51.

The corona charger 61 used for corona discharging is arranged in proximity to the surface of the developing roll 51 for uniformly electrifying the surface of the liquid developer layer 4 formed on the developing roll 51. With the corona charger 61, a discharging wire producing the corona charge is arranged within a charger box having an opening formed facing the surface of the photosensitive belt member 7.

With the above-described first embodiment of the developing device 60 employing the liquid developer, the developing roll 51 is run in rotation in a direction indicated by arrow M in FIG. 7 for picking up a large quantity of the liquid developer 1 from the developer tank 53 for forming the liquid developer layer 4. The electrical voltage applied across a discharging wire of the corona charger 61 is then raised gradually. If the electrical field exceeds a critical value, corona discharging is produced from the discharging wire for electrifying the surface of the liquid developer layer 4 formed on the developing roll 51.

Figure 11:
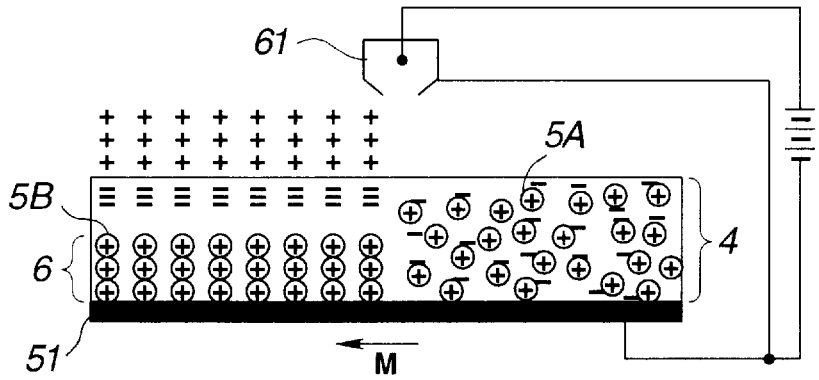
FIG. 11 schematically shows the state of forming a liquid toner layer on a developer roll by the developing device of FIG. 9.
Figure 12:
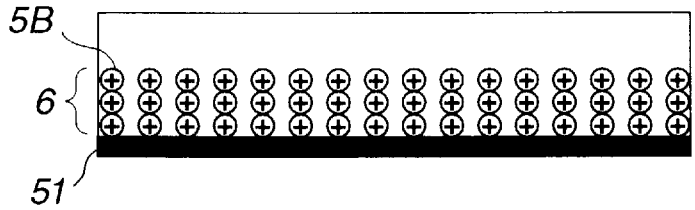
FIG. 12 schematically shows the liquid toner layer formed by the developing device of FIG. 9.

As the developing roll 51 is run in rotation in a direction indicated by arrow M in FIG. 11, the corona charger 61 uniformly electrifies the entire surface of the liquid developer layer 4 on the developing roll 51 to positive charges. The charged toner particles 5A in the liquid developer layer 4 are electrified by this electrifying process by the corona charger 61 to positive charges. The charged toner particles 5B, thus electrified, are migrated towards a developer roll 51, as shown in FIG. 12, so as to be collected on the developer roll 51 to form the liquid toner layer 6.

The developer roll 51, having the liquid toner layer 6 thus formed on its surface, is further rotated in a direction as indicated by arrow M in FIG. 9 and brought into contact with the photoconductive belt member 7. At this time, the liquid toner layer 6 is supplied to the surface of the photoconductive belt member 7 for forming a developed image from the electrostatic latent image on the photoconductive belt member 7.

If the developer device 60 employing the liquid developer is implemented as a printer designed for expressing the gradation, it is possible with the developing device 60 employing the liquid developer to continuously vary the thickness of the liquid toner layer 6 developed on the photoconductive belt member 7 by continuously varying the surface potential of the photoconductive belt member 7.

Also, if the above-described developer device 60 is implemented as the bi-level printer, it becomes possible to leave the liquid toner layer 6 in its entirety on the developer roll 51 with a margin to produce a white portion or to develop the liquid toner layer 6 in its entirety on the photoconductive belt member 7 for forming a black portion.

The liquid developer 57, left on the developer roll 51, is then scraped by a scraper from the surface of the electrical field impressing roll 52 and recovered in the recovery tank 54. The recovered liquid developer is adjusted in toner particle density and re-used.

Figure 13:
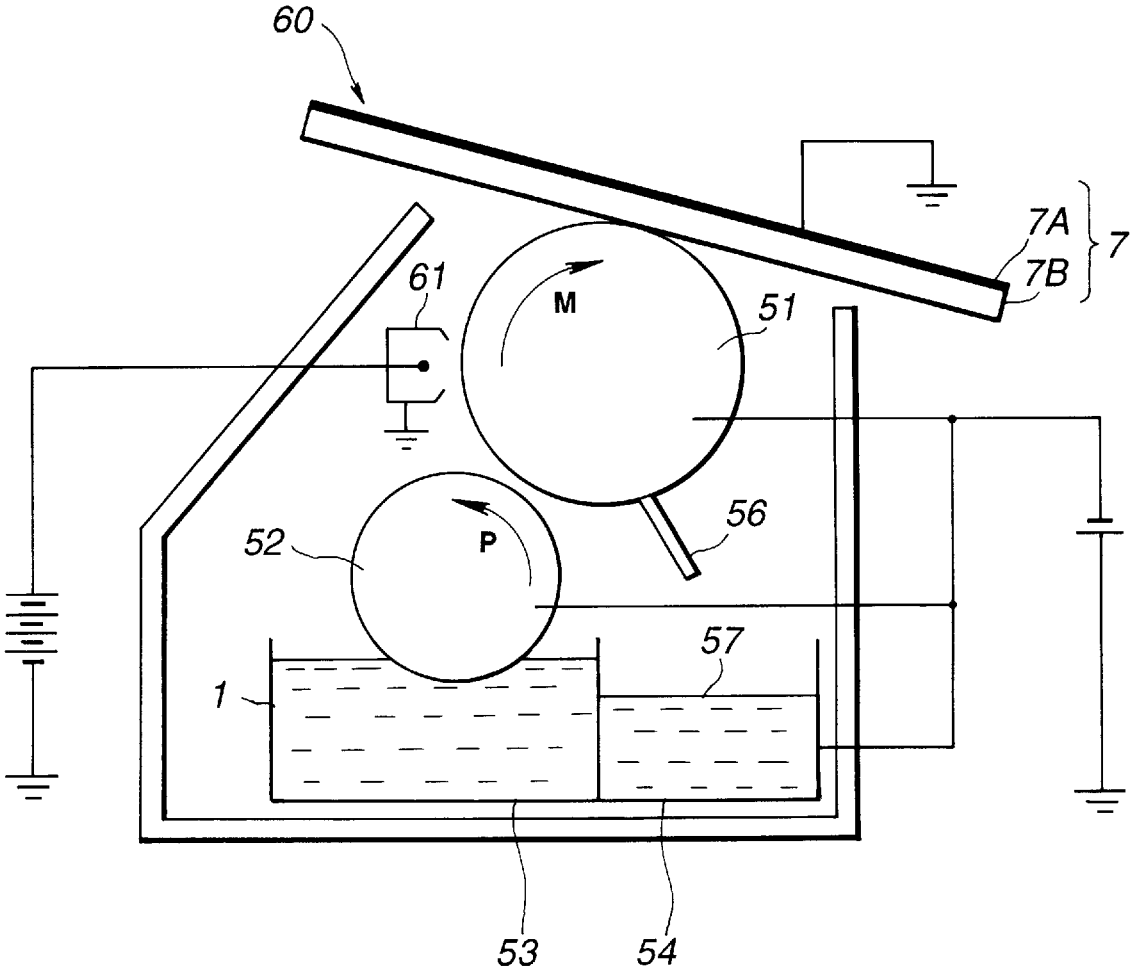
FIG. 13 is a schematic view for illustrating another embodiment of the developing device.

In the developing device 60 employing the liquid developer, according to the embodiment of FIG. 9, the liquid developer is directly picked up for forming the liquid developer layer 4. Alternatively, the liquid developer layer 4 may be formed via supply roll 52, as shown in FIG. 13.

At this time, an electrical voltage equal to the potential applied across the developer roll 51 is applied across the supply roll 52. First, the supply roll 52 is run in rotation in a direction indicated by arrow P in FIG. 13 for picking up a large quantity of the liquid developer 1 from the developer tank 53. This developer is deposited on the supply roll 52. The supply roll 52 is further rotated for removing the superfluous liquid developer 1, so that the liquid developer layer 4 having the thickness substantially equal to the distance between the rolls 51 and 52 is formed between the rolls 51 and 52.

With the above-described embodiment of the developing device 60 employing the liquid developer, the liquid developer 1 is deposited on the developing roll 51, while an electrical field is impressed for forming the liquid toner layer 6. The photosensitive belt member 7 is then brought into pressure contact with the liquid toner layer for effecting the development. Thus, the charged toner particles 5B are not migrated, as in the case of the electrophoretic development, but the liquid toner layer 6 is separated in the direction of the electrical field formed in the liquid toner layer 6, so that development is realized in conjunction with the above pressure contact, thus realizing high-speed development.

Moreover, with the developing device 60 employing the liquid developer, since the liquid toner layer 6 is first formed on the developing roll 51, and subsequently pressure-contacted with the photosensitive belt member 7, no superfluous liquid developer layer 4 is formed on the photosensitive belt member 7, so that the squeezing operation for the excess superfluous liquid developer layer 4, as required in the conventional electrophoretic development device 100, may be eliminated.

Also, with the developing device 60 employing the liquid developer, if the liquid toner layer 6 is formed on the developing roll 51, the liquid toner layer 6 is separated depending on the direction of the electrical field generated in the liquid toner layer 6, so that development is performed in conjunction with the above pressure contact between the liquid toner layer and the photosensitive belt member 7. Thus, the charged toner particles 5B faithfully corresponding to the charge density on the photosensitive belt member 7 may be developed, thus realizing a uniform developer image having uniform half-tone density.

In addition, with the developing device 60 employing the liquid developer, since it is only necessary that the liquid toner layer 6 be formed on the developing roll 51, base surface pollution or deposition of excess charged toner particles 5B on the image area, as encountered in the conventional electrophoretic development device 100, may be eliminated, thus enabling the use of the high-density liquid developer 1.

Therefore, with the developing device 60 employing the liquid developer, since the developing speed is high and the squeezing processing is eliminated, while uniform half-tone density and graininess may be easily realized and the high-density liquid developer may be used, a high-definition liquid-development image may be realized speedily and easily with a small-sized developing device.

A developing device 70, as the second embodiment, is characterized by electrifying the liquid developer layer 4 deposited on the developer roll 51 by impressing the electrical field by contacting an electrical field impressing electrode plate 71 with the liquid developer layer 4 deposited on the developer roll 51 instead of by using the electrical field impressing roll 52. With the developing device 70 employing the liquid developer, the developer tank 53 is arranged so that part of the peripheral surface of the developer roll 51 is directly dipped in the liquid developer 1. The same voltage is applied across the developer tank 53 as that applied across the developing roll 51. With the developing device 70, employing the liquid developer, the electrical field impressing electrode plate 71 is contacted with the liquid developer layer 4 formed by deposition of the liquid developer 1 on the developing roll 51.

Figure 14:
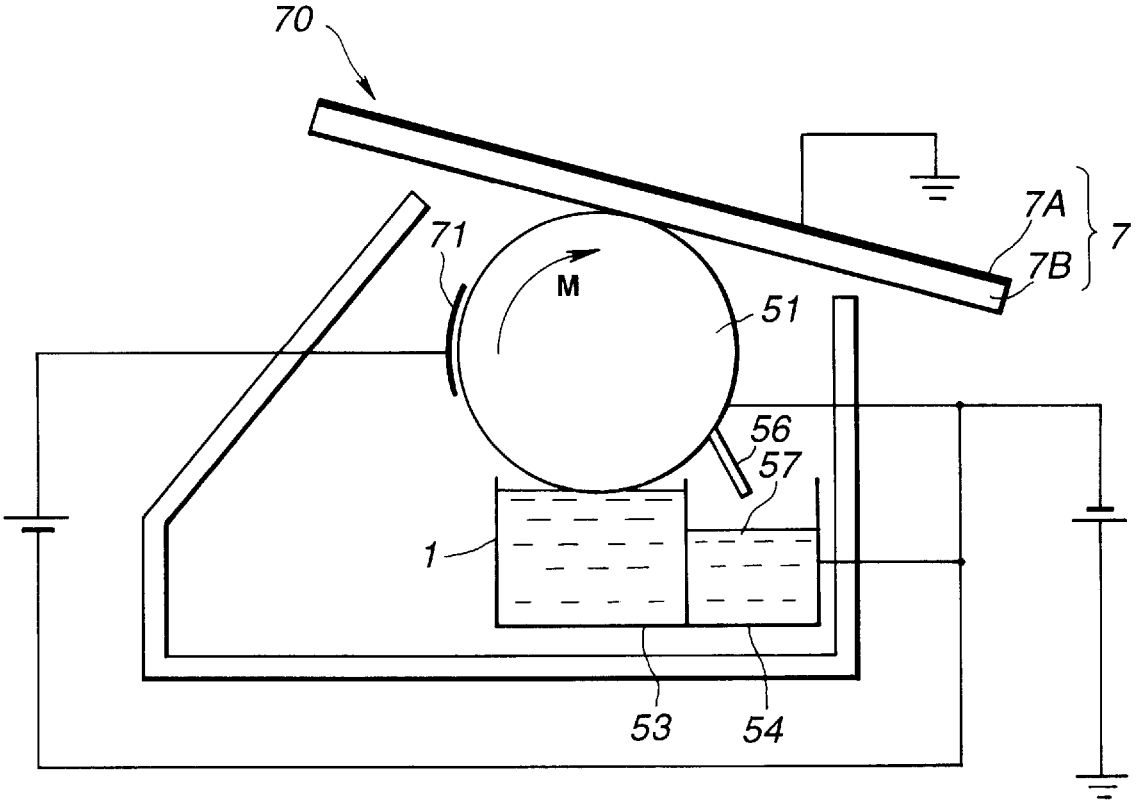
FIG. 14 is a schematic view for illustrating a second embodiment of a developing device employing the above liquid developer.

This electrical field impressing electrode plate 71 is secured for forming a gap between it and the surface of the developing roll 51 for forming a meniscus of the liquid developer 1, as shown in FIG. 14. A positive potential relative to the potential of the developing roll 51 is impressed across the electrical field impressing electrode plate 71 formed of an electrically conductive material and which is warped to conform to the periphery of the developing roll 51.

Figure 15:
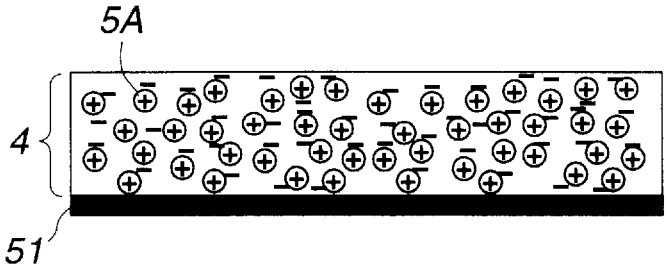
FIG. 15 schematically shows a liquid developer layer formed on the developer roll by the developing device of FIG. 14.
Figure 16:
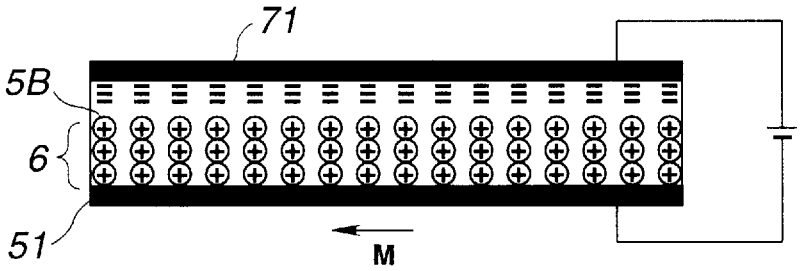
FIG. 16 schematically shows the state of forming a liquid toner layer on a developer roll by the developing device of FIG. 14.

With the above-described second embodiment of the developing device 70 employing the liquid developer, the developing roll 51 is run in rotation in a direction indicated by arrow M in FIG. 14 for picking up a large quantity of the liquid developer 1 from the developer tank 53 for forming the liquid developer layer 4, as shown in FIG. 15. The electrical field impressing electrode plate 71 is then contacted in this state with the surface of the liquid developer layer 4 on the developing roll 51, as shown in FIG. 16. The electrical field impressing electrode plate 71 is contacted at this time with the entire surface of the liquid developer layer 4 formed on the developing roll 51, by the developing roll 51 being run in rotation in a direction indicated by arrow M in FIG. 16.

Figure 17:
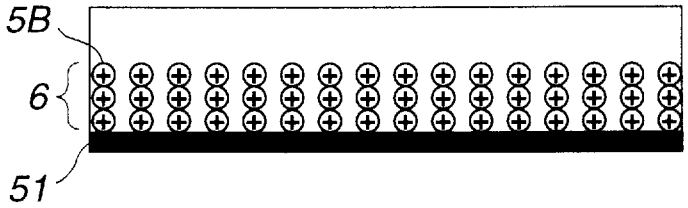
FIG. 17 schematically shows the liquid toner layer formed by the developing device of FIG. 14.
Figure 18:
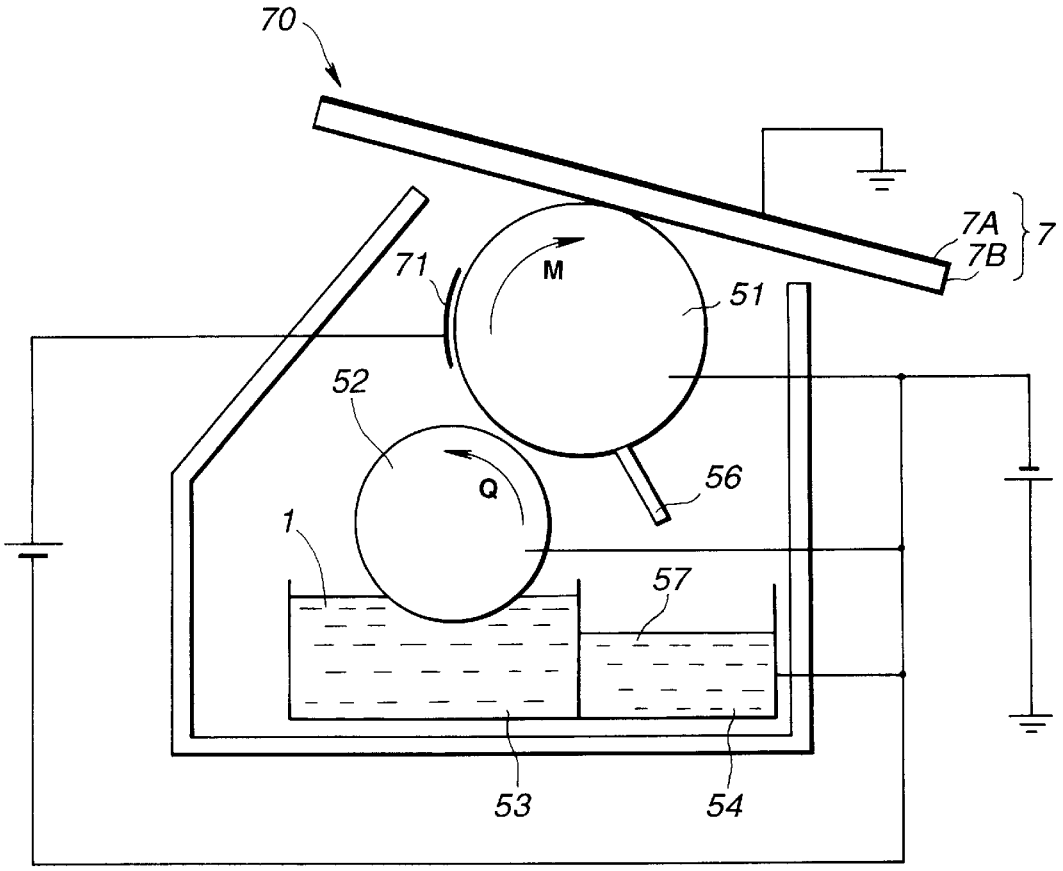
FIG. 18 is a schematic view for illustrating still another embodiment of the developing device.

The electrical field impressing electrode plate 71 then produces the electrophoretic phenomenon in the charged toner particles 5A in the liquid developer layer 4 depending on the difference between the electrical potential across the plate 71 and that across the developing roll 51. The charged toner particles 5A in the liquid developer layer 4 are attracted by the developer roll 51, which is at a lower electrical potential than that of the electrical field impressing electrode plate 71, while being electrified to a plus charge by the electrical field impressing electrode plate 71 and the developer roll 51. The electrified toner particles 5B are migrated towards the developer roll 51, as shown in FIG. 17, so as to be collected on the developing roll 51 to form a liquid toner layer 6.

The developing roll 51, on the surface of which the liquid toner layer 6 has been formed, is further run in rotation in a direction indicated by arrow N in FIG. 4 so as to be contacted with the photosensitive belt member 7. The liquid toner layer 6 is supplied at this time to the surface of the photoconductive belt member 7 for forming a developer image from the electrostatic latent image on the photoconductive belt member 7.

If the above-described developing device 70 is implemented as a printer designed for expressing graduations, it is possible with the developing device 70 employing the liquid developer to continuously vary the thickness of the liquid toner layer 6 developed on the photosensitive belt member 7 by continuously varying the-surface potential of the photosensitive belt member 7.

Also, if the above-described developer device 60 is implemented as the bi-level printer, it becomes possible to leave the liquid toner layer 6 in its entirety on the developer roll 51 with a margin to produce a white portion or to develop the liquid toner layer 6 in its entirety on the photoconductive belt member 7 for forming a black portion.

The liquid developer 57, left on the developer roll 51, is then scraped by a scraper 56 from the surface of the electrical field impressing roll 52 and recovered in the recovery tank 54. The recovered liquid developer is adjusted in toner particle density and re-used.

In the developing device 60 employing the liquid developer, according to the first embodiment, the liquid developer is directly picked up for forming the liquid developer layer 6. Alternatively, the liquid developer layer 4 may be formed via supply roll 52, as shown in FIG. 13.

At this time, an electrical voltage equal to the potential applied across the developer roll 51 is applied across the supply roll 52. First, the supply roll 52 is run in rotation in a direction indicated by arrow P in FIG. 13 for picking up a large quantity of the liquid developer 1 from the developer tank 53. This developer is deposited on the supply roll 52. The supply roll 52 is further run in rotation for removing superfluous liquid developer 1, so that the liquid developer layer 4 having the thickness substantially equal to the distance between the rolls 51 and 52 is formed between the rolls 51 and 52.

In the developing device 70 employing the liquid developer, according to the second embodiment, the electrical field impressing electrode plate 71 is used. However, a rod or a roll, not shown, may also be used in place of electrical field impressing electrode plate 71. If the roll is used, it is rotated in the opposite direction to the direction of rotation of the developing roll 51, or in the forward direction.

With the above-described second embodiment of the developing device 70 employing the liquid developer, the liquid developer 1 is deposited on the developing roll 51, while an electrical field is impressed for forming the liquid toner layer 6. The photosensitive belt member 7 is then brought into pressure contact with the liquid toner layer for effecting the development. Thus, the charged toner particles 5B are not migrated, as in the case of the electrophoretic development, but the liquid toner layer 6 is separated in the direction of the electrical field formed in the liquid toner layer 6, for development in conjunction with the above-described pressure contact, thus realizing high-speed development.

Moreover, with the developing device 70 employing the liquid developer, since the liquid toner layer 6 is first formed on the developing roll 51, and subsequently pressure-contacted with the photosensitive belt member 7, no superfluous liquid developer layer 4 is formed on the photosensitive belt member 7, such that the squeezing operation for the excess superfluous liquid developer layer 4, as required in the conventional electrophoretic development device 100, may be eliminated.

Also, with the developing device 70 employing the liquid developer, if the liquid toner layer 6 is formed on the developing roll 51, the liquid toner layer 6 is separated depending on the direction of the electrical field generated in the liquid toner layer 6, so that development occurs in conjunction with the above-described pressure contact. Thus, the charged toner particles 5B faithfully corresponding to the charge density on the photosensitive belt member 7 may be developed for realizing a uniform developer image having uniform half-tone density.

In addition, with the developing device 70 employing the liquid developer, since it is only necessary that the liquid toner layer 6 be formed on the developing roll 51, base surface pollution or deposition of excess charged toner particles 5B on the image area, as encountered in the conventional electrophoretic development device 100, may be eliminated to enable the use of the high-density liquid developer 1.

Therefore, with the developing device 70 employing the liquid developer, since the developing speed is high and the squeezing processing is eliminated, while uniform half-tone density and graininess may be easily realized and the high-density liquid developer may be used, a high-definition liquid-development image may be realized speedily and easily with a small-sized developing device.

The developing device employing the liquid developer according to the present invention may be applied to an image forming device other than the above-described laser printer 10, such as a laser printer 40. The laser printer 40 is similar to the laser printer 10 except having a photosensitive drum member 41 in place of the set of rolls used for running the photosensitive belt member 7. In the following description, the parts or components similar to those of the laser printer 10 are denoted by the same reference numerals and the corresponding description is not made.

Figure 19:
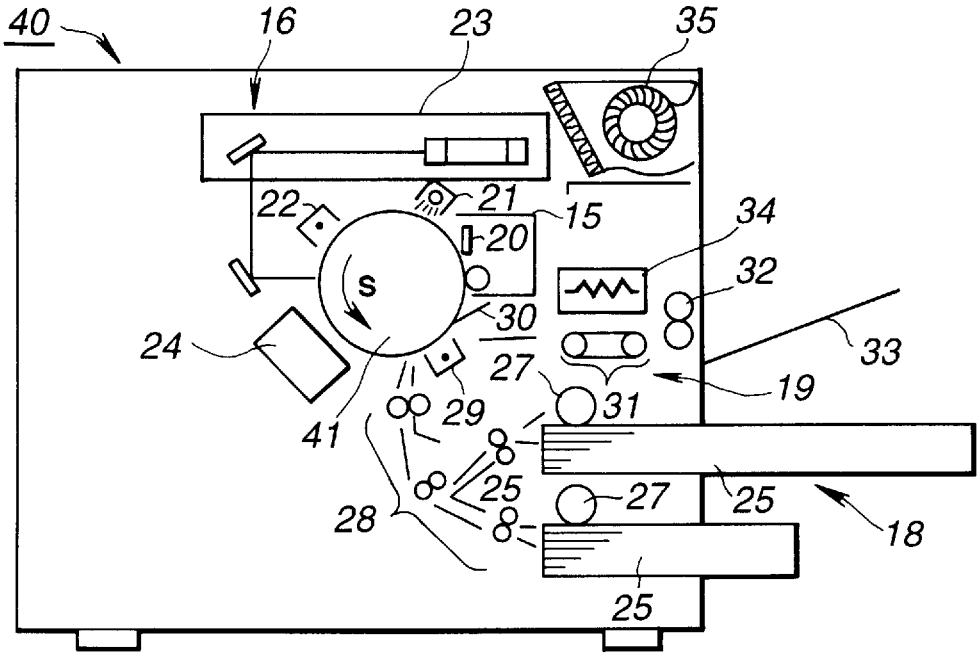
FIG. 19 schematically shows another laser printer according to the present invention.
Figure 20:
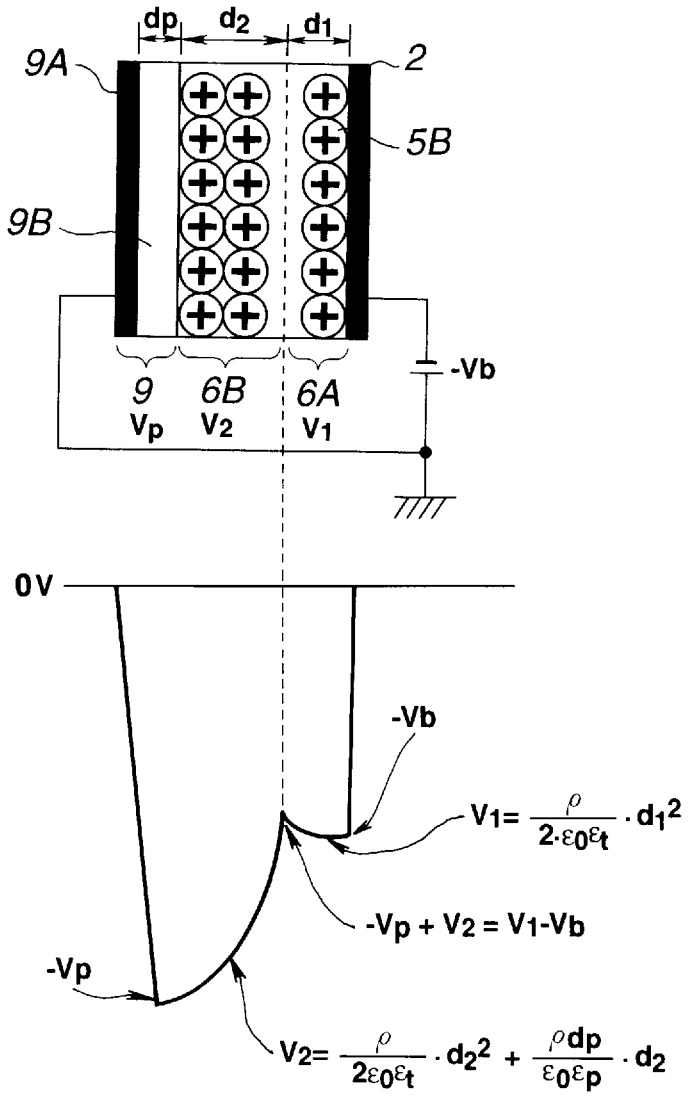
FIG. 20 is a schematic view for illustrating the state under which the equilibrium potential separation phenomenon occurs.

Referring to FIG. 19, the laser printer 40 includes the photosensitive drum member 41, cleaning unit 15 and the image-forming processing unit 16. The laser printer 40 also includes the transfer-separation unit 17, recording sheet supplying unit 18 for supplying a recording sheet to the transfer-separation unit 17, and the discharging unit 19 for discharging the recording sheet 25 separated from the photosensitive drum member 41. The photosensitive drum member 41 is comprised of an electrically conductive substrate on the surface of which is formed a photosensitive layer formed of an organic or inorganic photoconductive member. The photosensitive drum member 41 is run in rotation by driving means, not shown, in a direction indicated by arrow S in FIG. 19. The image-forming processing unit 16 is provided with one of the above-mentioned developing devices 24, 60 or 70 employing the liquid developer.

The theory of development employing the present developing device is now explained and experimentally verified. First, the theory of the development is explained.

If, at the time point when development comes to a close, the thickness of the liquid toner layer 6 remaining on the developer carrier 2 is $d_1$ and the thickness of the liquid toner layer 6B deposited to the charge carrier 9 is $d_2$, the thickness dt of the liquid toner layer 6 formed on the developer carrier 2 prior to development is given by the equation (1):

$$d_t=d_1+d_2 \ldots \quad (1)$$

On the other hand, the potential $V_1$ of the liquid toner layer 6A along the thickness from the developer carrier 2 is given by the equation (2):

$$V_1=\rho(d_1)^2/2\Sigma_0\Sigma_t \ldots \quad (2)$$

where ρ is the current density of the liquid toner layer 6B, $\epsilon_0$ is the dielectric constant of vacuum, $\epsilon_t$ is the specific dielectric constant of the liquid toner layer 6B and $d_1$ is the thickness of the liquid toner layer 6B affixed to the developer carrier 2.

The toner potential $V_2$ of the liquid toner layer 6B in the direction of thickness from the charge carrier 9 is given by the equation (3):

$$V_2=\rho(d_2)^2/2\epsilon_0\epsilon_t+\rho d_p d_2/\epsilon_0\epsilon_p \ldots \quad (3)$$

where ρ is the charge density of the liquid toner layer 6B, $\epsilon_0$ is the dielectric constant of vacuum, $\epsilon_t$ is the specific dielectric constant of the liquid toner layer 6B, $\epsilon_p$ is the specific dielectric constant of the charge carrier 9, $d_2$ is the thickness f the liquid toner layer 6B deposited on the charge carrier 9 and $d_p$ is the thickness of the photosensitive layer 9B of the charge carrier 9.

If the voltage applied across the developer carrier 2 is $-V_b$ and the surface potential of the charge carrier is $-V_p$, the sum of the potential across the developer carrier 2 and the potential across the liquid toner layer 6A deposited thereon subsequent to development is $(V_1-V_b)$, while the sum of the potential across the charge carrier 9 and the potential across the liquid toner layer 6A deposited thereon after development is $(-V_p+V_2)$.

If the above-mentioned developing devices 24, 60 or 70 is implemented as a gradation representing printer, the surface potential of the charge carrier 9 can be continuously varied for continuously varying the thickness of the liquid toner layer 6 developed on the charge carrier 9.

In such case, such toner potentials $V_1$, $V_2$ exist that the total potential of the developer carrier 2 and the liquid toner layer 6A left thereon after development $(V_1-V_b)$ becomes equal to the total potential of the charge carrier 9 and the liquid toner layer 6B developed thereon $(-V_p+V_2)$, as indicated by the following equation (4):

$$-V_p+V_z=V_1-V_B \ldots \quad (4)$$

In the vicinity of a point where the equation (4) holds, the liquid toner is attracted towards the developer carrier 2 and towards the charge carrier 9 if the toner is located closer to the developer carrier 2 or towards the charge carrier 9, respectively. Thus the liquid toner layer 6 is separated into a liquid toner layer 6A towards the developer carrier 2 and a liquid toner layer 6B towards the charge carrier 9, with the point represented by the equation (4) as a boundary. The state of separation of the liquid toner layer 6 may be found by solving the equations (1), (2) and (3) for $d_2$, as shown by the equation (5):

$$d_1=\{(1/(d_t/\epsilon_t+d_p/\epsilon_p)\}\times\{(V_p-V_b)\epsilon_0/\rho+(d_t)^2/2\epsilon_5\}. \ldots \quad (5)$$

Substituting the value of $d_2$ thus found into the equation (1) and finding $d_1$, the following equation (3') is obtained:

$$d_1=d_t-d_2 \ldots \quad (3')$$

That is, if there exist $V_1$ and $V_2$ for which the equation (4) holds, $d_1$ and $d_2$ are uniquely defined, and the respective values are found by the equations (5) and (3'). On the other hand, if the developing devices employing the liquid developer 24, 60 or 70 are executed so that the equation (4) is satisfied, the thickness $d_2$ of the liquid toner layer 6B affixed to the charge carrier 9 may be continuously changed by continuously changing the potential $-V_p$ of the surface potential of the charge carrier 9, as will become apparent from the equation (5).

Therefore, the above-mentioned developing devices employing the liquid developer 24, 60, 70 are suited to be implemented as the gradation representing printer if used within the range of the equation (4).

Also, if the above-described developer device 24, 60 or 70 is executed as the bi-level printer, it becomes possible to leave the liquid toner layer 6 in its entirety on the developer roll 51 with a margin to produce a white portion or to develop the liquid toner layer 6 in its entirety on the photoconductive belt member 7 for forming a black portion.

Figure 21:
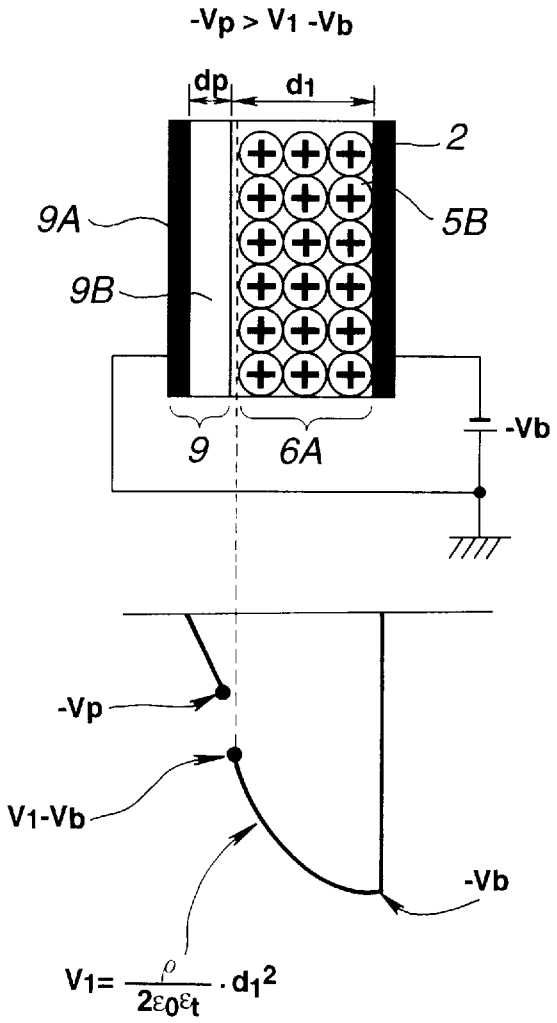
FIG. 21 is a schematic view for illustrating the state under which the liquid toner layer is left in its entirety on the developer carrier side.
Figure 22:
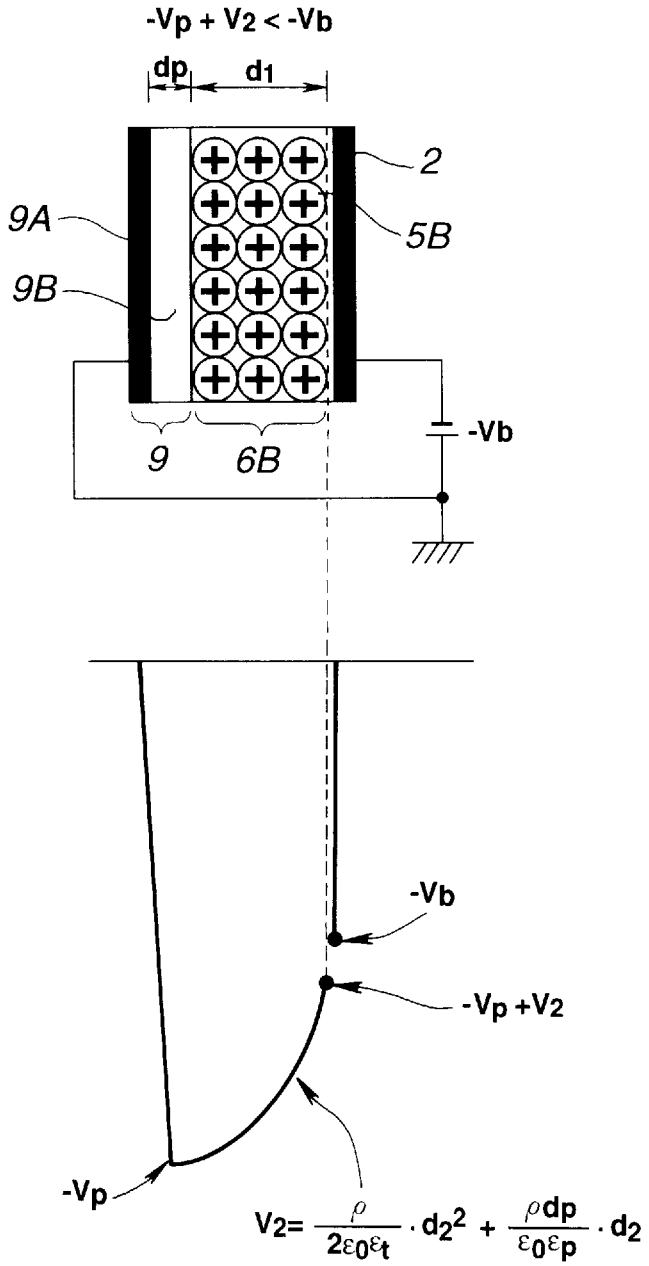
FIG. 22 is a schematic view for illustrating the state under which the liquid toner layer is developed in its entirety on the charge carrier side.
Figure 23:
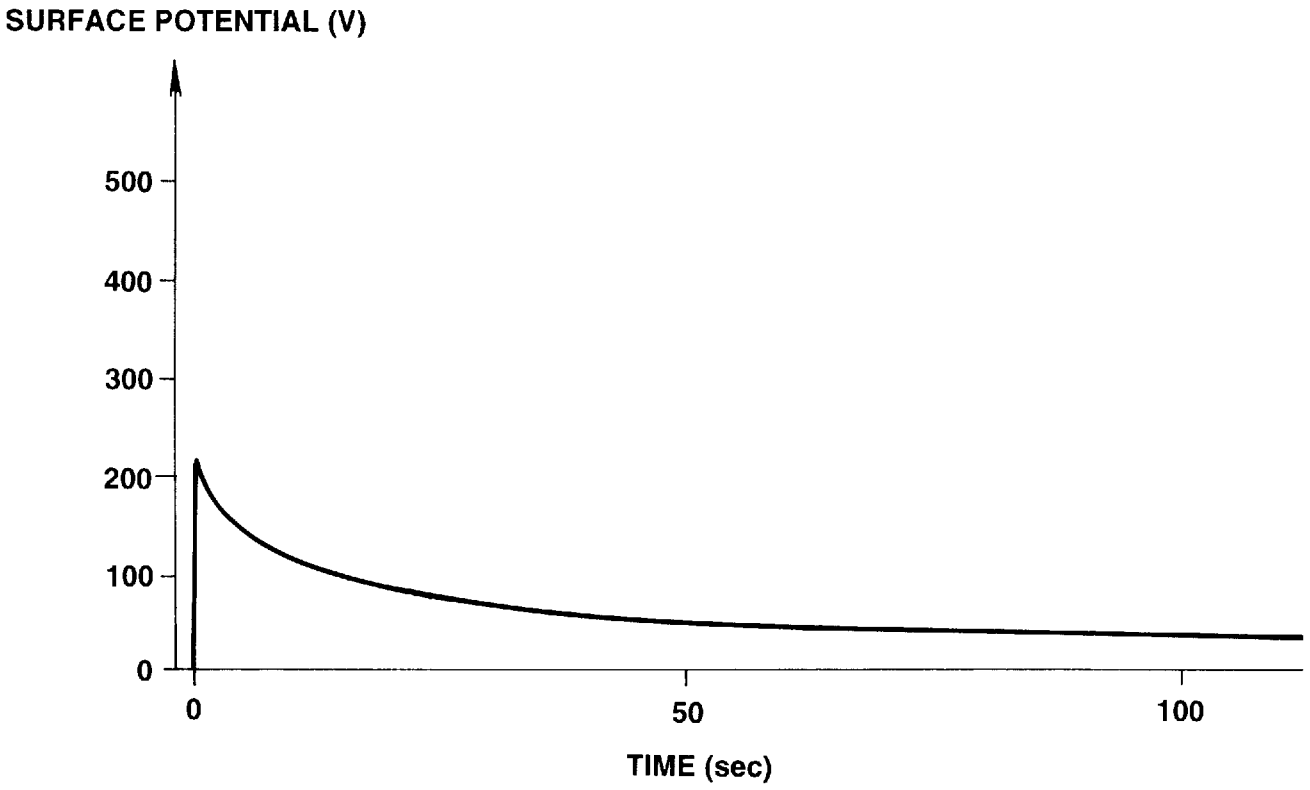
FIG. 23 is a graph showing the surface potential of toner particles.

In this case, $(V_1-V_b)$ is not equal to $(-V_P+V_2)$, as shown in FIGS. 21 and 22.

It is first assumed that the liquid toner layer 6 charged to the positive terminal is left in its entirety on the developer carrier 2, as shown in FIG. 14. If the value of $V_1$ is $V_{I(t)}$, the state of the potential is given by the equation (6):

$$-V_{p>V1(t)}-V_b(V_2=0)\ldots \quad (6)$$

The equation (6) means that the potential $\{V_{1(t)}-V_b\}$ on the developer carrier 2 is lower than the potential $-V_P$ of the electrostatic latent image formed on the surface of the charge carrier 9. Thus the liquid toner layer 6, charged to the positive polarity, remains attracted in its entirety by the developer carrier 2. The result is that the thickness of the liquid toner layer 6B affixed to the charge carrier 9 becomes equal to zero. That is, in the case of the equation (4), the equations $d_1=d_t$ and $d_2=0$ necessarily hold.

Therefore, if the developing devices employing the liquid developer 24, 60 or 70 are implemented as a monochromatic printer, that is a bi-level printer, the liquid toner layer may be left in its entirety on the developer carrier 2 with a margin under the condition of the equation (6). In this case, the condition for producing a white area is met.

It is then assumed that the liquid toner layer 6 charged to the positive polarity is affixed in its entirety on the charge carrier 9, as shown in FIG. 22. If the value of $V_2$ at this time is $V_{2(t)}$, the potential state in this case is given by the equation (7):

$$-V_p+V_{2(t)}<-V_b(V_1=0)\ldots \quad (7)$$

This equation means that, if the liquid toner layer 6 charged to the positive polarity is developed in its entirety on the side of the charge carrier 9, the potential of the charge carrier 9 $\{-V_p+V_2(t)\}$ is still lower than the potential $-V_b$ on the side of the developer carrier 2, such that the liquid toner layer 6, charged to the positive polarity, in its entirety remains attracted to the charge carrier 9. The thickness of the liquid toner layer 6A left on the developer carrier 2 becomes equal to zero. That is, in the case of the equation (4), the equations $d_1=0$ and $d_2=dt$ necessarily hold.

Therefore, if the developing devices employing the liquid developer 24, 60 or 70 are implemented as a bi-level printer, the liquid toner layer 6 may be left in its entirety on the charge carrier 9 with a margin under the condition of the equation (6). In this case, the condition for producing a black area is met.

The liquid developer 57 left on the electrical field impressing roll 3 and the developer carrier 2 is scraped by the scraper 56 from the surface of the electrical field impressing roll 3 so as to be recovered in the recovery tank 54. The liquid developer 1 thus recovered is re-used after adjusting the density of the toner particles.

The charge carrier 9 is not limited to one comprised of the electrically conductive substrate 9A on the surface of which is formed the photosensitive layer 9B, but may also be such a carrier in which an electrostatic latent image is formed on the surface of a dielectric material by, for example, an electrified needle.

The above-described theory of the present invention is now verified by experiments. A positively charged liquid developer with a current density of 37 $\mu$c/cm3 and a density of 5 wt % was used for the experiments.

The liquid toner layer 6 was formed in the following manner. Specifically, the liquid developing agent 1 was charged in a space between the electrodes having a gap of 50 $\mu$m and a voltage of 500 V was applied across the electrodes. The charged toner particles 5B migrate under electrophoresis towards the negative electrode to form the liquid toner layer 6 formed by the charged toner particles assembled together. The surface potential of the charged toner layer was approximately 200 V. While the surface potential of the liquid toner layer 6 was attenuated with time as shown in FIG. 16, the time constant $\tau$ until the potential reaches a value of 1/e of the peak value is approximately 23 seconds.

The charge carrier was then applied under pressure against the liquid toner layer 6 formed between the metal electrodes for development. A polyethylene terephthalate (PET) film, 50 $\mu$m in thickness, having a transparent electrode deposited thereon by vacuum deposition, was used as the charge carrier 9 in place of an organic photoconductor (OPC). In several seconds after formation of the liquid toner layer 6, the above PET, organic photoconductor (OPC). In several seconds after formation of the liquid toner layer 6, the above PET, uniformly charged to various potential values, was applied under pressure to the liquid toner layer 6 for development in accordance with the present invention. Meanwhile, a bias voltage of -60 V is applied across the metal electrodes supporting the liquid toner layer 6 after formation of the liquid toner layer 6.

Figure 24:
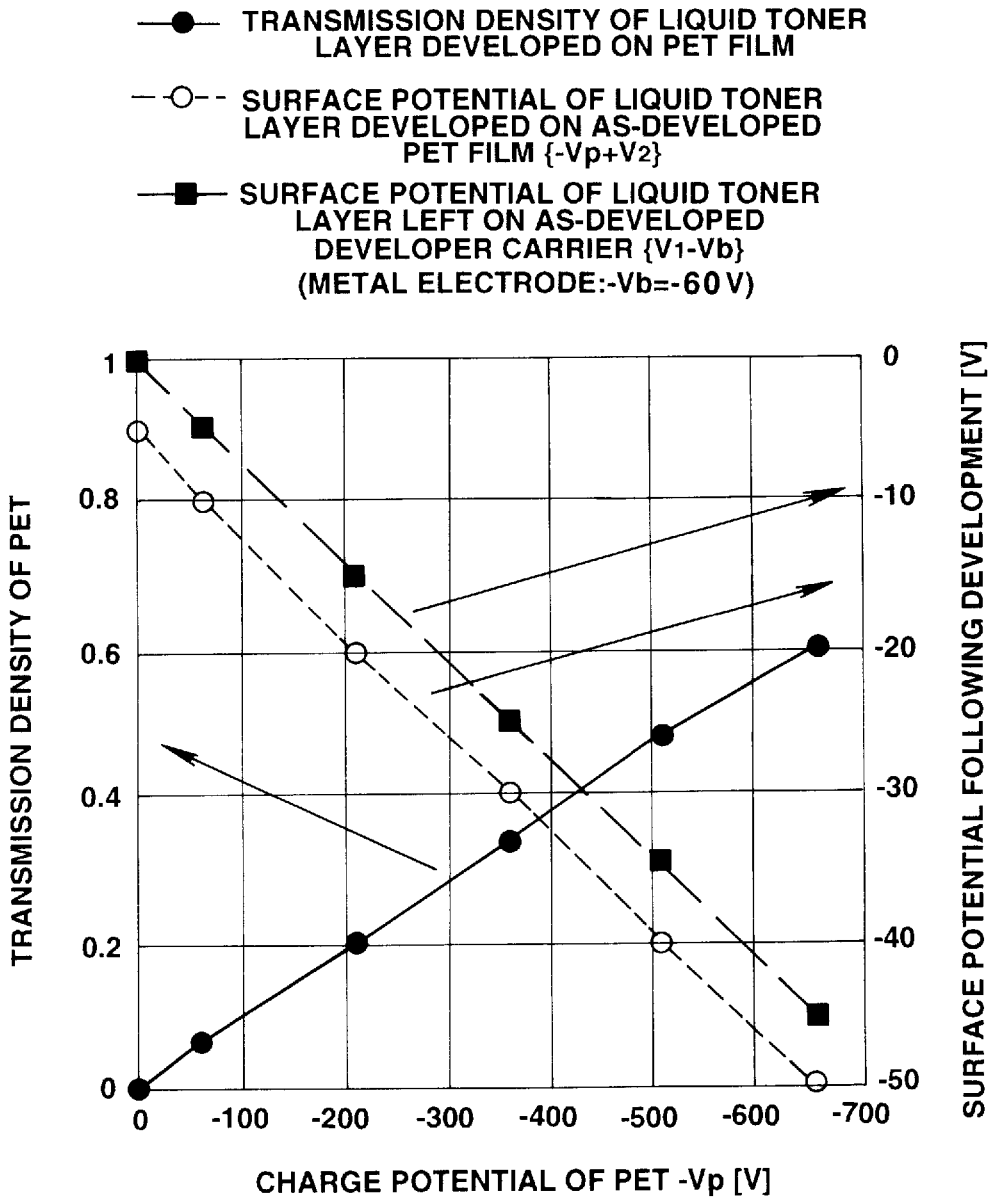
FIG. 24 is a graph showing the transmission density of the liquid toner layer developed on a PET film as measured after development, surface potential of the liquid toner layer developed on the PET film ($-V_P+V_2$) and the surface potential of the liquid toner layer left on a developer carrier ($V_1-V_b$).

FIG. 24 shows the relation between the charging potential of a PET film on one hand and measured values of the transmission density of the liquid toner layer 6B developed on the PET film, the surface potential $(-V_p+V_2)$ of the liquid toner layer 6B developed on the PET film and the surface potential $(V_1-V_b)$ of the liquid toner layer left on the developer carrier.

It is seen that the surface potential $(-V_p+V_2)$ of the liquid toner layer 6B developed on the as developed PET film and the surface potential $(V_1-V_b)$ of the liquid toner layer 6A left on the developer carrier are increased substantially equally with increase in the negative direction of the charge potential $(-V_p)$ of the PET film. It is also seen that the thickness of the liquid toner layer 6B developed on the PET film is increased with increase in the negative direction of the charge potential $(-V_p)$ of the PET film. It is seen that the results of the present experiment prove that the equation (4) holds, while verifying the equation (5).

Although the positive development method for developing the electrostatic latent image with charged toner particles 5B of the opposite polarity to that of the latent image has been explained in the present experimental example, it is of course possible to envisage the reversal method of developing non-charged areas of an image using toner particles charged to the opposite polarity to that of the charge carrier 9.

In the foregoing, description has been made of developing the positive developing device employing the charged toner particles 5B having the opposite polarity to that of the electrostatic latent image. However, the present invention may naturally be applied to a reversal development device designed for developing chargeless area using the charged toner particles having the same polarity as that of the electrostatic latent image.

In the foregoing, the equations (4) to (6) have been used for verifying the case of developing the positively charged toner particles on the negatively charged charge carrier 9. These equations are represented by the following general equations, in which the letters can take positive and negative values:

$$V_p+V_2=V_1+V_b \ldots \quad (4')$$

$$V_p>V_{1(i)}+V_b(V_2=0) \ldots \quad (6')$$

$$V_p+V_{2(i)}<V_b(V_1=0) \ldots \quad (7')$$

These equations (4'), (6') and (7') can represent developing conditions not only for the positive developing method of developing an image using toner particles charged to the opposite polarity to that of the electrostatic latent image but also for the reversal process of developing a chargeless image area with toner particles charged to the same polarity as that of the charge carrier.

That is, the equation (4') is a general formula representing the condition for the phenomenon of equilibrium potential separation to take place, while the equation (6') is a general formula representing the condition under which the liquid toner layer is left in its entirety on the developer carrier 8 and the equation (7') is a general formula representing the condition under which the liquid toner layer is affixed in its entirety on the charge carrier 15.

The present invention has been described with reference to an electrophotographic printer of the indirect transfer system employing a photosensitive member for an embodiment of the developing device and an embodiment of the image forming device employing the liquid developer according to the present invention. However, of course, the present invention may also be applied to an electrophotographic duplicator, a microfilm reader printer or a facsimile.

The present invention may, of course, be applied to an image forming device configured for forming an electrostatic latent image on a charge carrier by an ion flow or a multi-stylus system without using a photosensitive member.

The present invention may also naturally be applied to an electrostatic plotter or printer in which an electrostatic latent image is formed on a recording member as a charge carrier by an ion flow or a multi-stylus system for directly developing the recording member.

Although the present invention has been described above in connection with a monochromatic printer, it may naturally be applied to a color printer.

What is claimed is:

1. A developing apparatus employing a liquid developer for developing an image on a charge carrier having a surface potential $V_p$, the apparatus comprising:

a developer container containing the liquid developer comprised of charged toner particles at least made up of a coloration agent and a resin, said charged toner particles being dispersed in an electrically insulating liquid;

a developer carrier;

developer supplying means for uniformly depositing the liquid developer from said developer container on a surface of the developer carrier having a surface potential $V_b$; and electrical field impressing means for creating an electrical field impressed across the liquid developer deposited on the surface of said developer carrier, thereby forming a liquid toner layer comprised of charged toner particles assembled together on the surface of said developer carrier, said liquid toner layer having a potential $V_1$ in a direction of thickness of the developer carrier and having a potential $V_2$ in a direction of thickness of the charge carrier, wherein said developer carrier holding the liquid toner layer comprised of charged toner particles assembled together is subsequently brought into pressure contact with the charge carrier, having formed thereon an electrostatic latent image, in order to effect development under a condition in which the following equation holds:

$$V_p+V_2=V_1+V_b.$$

2. An image forming device comprising;

a charge carrier having a surface potential $V_p$;

electrostatic latent image forming means for forming an electrostatic latent image on a surface of said charge carrier based on an image signal; and developing means for supplying a liquid developer to the surface of said charge carrier for developing an electrostatic latent image;

said developing means including a developer container containing a liquid developer comprised of charged toner particles at least made up of a coloration agent and a resin, said charged toner particles being dispersed in an electrically insulating liquid, developer supplying means for uniformly depositing the liquid developer from said developer container on a surface of a developer carrier having a surface potential $V_b$, and electrical field impressing means for creating an electrical field impressed across the liquid developer deposited on the surface of said developer carrier, thereby forming a liquid toner layer comprised of charged toner particles assembled together, said liquid toner layer having a potential $V_1$ in a direction of thickness of the developer carrier, and having a potential $V_2$ in a direction of thickness of the charge carrier;

wherein said developer carrier holding the liquid toner layer comprised of charged toner particles assembled together is subsequently brought into pressure contact with the charge carrier, having formed thereon an electrostatic latent image, in order to effect development under a condition in which the following equation holds:

$$V_p+V_2=V_1+V_b.$$

3. A developing apparatus employing a liquid developer for developing an image on a charge carrier, the apparatus comprising:

a developer container containing the liquid developer comprised of charged toner particles at least made up of a coloration agent and a resin, said charged toner particles being dispersed in an electrically insulating liquid;

a developer carrier;

developer supplying means for uniformly depositing the liquid developer from said developer container on a surface of said developer carrier; and electrical field impressing means for creating an electrical field impressed across the liquid developer deposited on the surface of said developer carrier, thereby forming a liquid toner layer comprised of charged toner particles assembled together;

wherein said developer carrier holding the liquid toner layer comprised of charged toner particles assembled together is subsequently brought into pressure contact with the charge carrier, having formed thereon an electrostatic latent image, in order to effect development under a condition in which $V_P>V_1+V_b$ and $V_P>V_1+V_b$ hold for a the white portion and for a black portion of an image, respectively, where $V_p$ is a surface potential of the charge carrier, $V_b$ is a surface potential of the developer carrier, $V_1$ is the potential of the liquid toner layer in a direction of thickness of said developer carrier and $V_2$ is a toner potential of the liquid toner layer in a direction of thickness of the charge carrier.

4. An image forming device comprising;

a charge carrier;

electrostatic latent image forming means for forming an electrostatic latent image on the surface of said charge carrier based on an image signal; and developing means for supplying a liquid developer to the surface of said charge carrier for developing an electrostatic latent image;

said developing means including a developer carrier, a developer container containing the liquid developer comprised of charged toner particles at least made up of a coloration agent and a resin, said charged toner particles being dispersed in an electrically insulating liquid, developer supplying means for uniformly depositing the liquid developer from said developer container on a surface of said developer carrier, and electrical field impressing means for creating an electrical field impressed across the liquid developer deposited on the surface of said developer carrier, thereby forming a liquid toner layer comprised of charged toner particles assembled together on the surface said developer carrier;

wherein the developer carrier holding the liquid toner layer comprised of charged toner particles assembled together is subsequently brought into pressure contact with the charge carrier, having formed thereon an electrostatic latent image, in order to effect development under a condition in which $V_p>V_1+V_b$ and $V_p>V_1+V_b$ hold for a white portion of said electrostatic latent image and for a black portion of said electrostatic latent image, respectively, where $V_p$ is a surface potential of the charge carrier, $V_b$ is a surface potential of the developer carrier, $V_1$ is a potential of the liquid toner layer in a direction of thickness of the developer carrier and $V_2$ is a toner potential of the liquid toner layer in a direction of thickness of said charge carrier.

5. The image forming device as claimed in claim 4, wherein said toner potential $V_1$ is given by the equation:

$$V_1=\rho(d_2)^2/2\epsilon_0\epsilon_t$$

and the toner potential $V_2$ is given by the equation:

$$V_2=\rho(d_2)^2/2\epsilon_0\epsilon_t+\rho d_p d_2/\epsilon_0\epsilon_t$$

where $\rho$ is a current density of the liquid toner layer, $\epsilon_0$ is a dielectric constant of vacuum, $\epsilon_t$ is a specific dielectric constant of the liquid toner layer, $d_1$ is a thickness of the liquid toner layer affixed to the developer carrier vacuum, $d_2$ is a thickness of the liquid toner layer deposited on the charge carrier and $d_p$ is a thickness of a photosensitive layer of the charge carrier.

6. The image forming device as claimed in claim 5, wherein an electrostatic latent image controlling means varies the toner potential $V_2$ based on the image signal for varying the thickness $d_2$ of the liquid toner layer formed on a surface of said charge carrier.

* * * * *